United States Patent [19]

Chatham et al.

[11] Patent Number: 4,742,342

[45] Date of Patent: May 3, 1988

[54] VIDEO DISPLAY GENERATOR HAVING ALTERNATE DISPLAY MODES

[76] Inventors: Dale Chatham, 2202 Dennis Rd., Weatherford, Tex. 76086; Gerald E. Gaulke, 1308 Timber Valley, Lewisville, Tex. 75028

[21] Appl. No.: 774,060

[22] Filed: Sep. 9, 1985

Related U.S. Application Data

[63] Continuation of Ser. No. 488,743, Apr. 26, 1983, abandoned.

[51] Int. Cl.[4] ..... G09G 1/16

[52] U.S. Cl. ..... 340/723; 340/721; 340/745; 340/750

[58] Field of Search ..... 340/709, 750, 730, 703, 340/721, 745, 801, 800

[56] References Cited

U.S. PATENT DOCUMENTS

| | | | |
|---|---|---|---|
| 3,849,773 | 11/1974 | Katahira et al. | 340/801 |
| 3,868,673 | 2/1975 | Mau, Jr. et al. | 340/730 |
| 4,028,695 | 6/1977 | Saich | 340/709 |
| 4,445,115 | 4/1984 | Rudgard | 340/721 |
| 4,495,491 | 1/1985 | Postl | 340/709 |

*Primary Examiner*—Marshall M. Curtis
*Attorney, Agent, or Firm*—Wolf, Greenfield & Sacks

[57] ABSTRACT

Video control circuitry for controlling the video format presented to the cathode ray tube to provide a combination of character generation and cell generation along with selective character inversion on a character-by-character basis. The video controller may comprise a video memory means for storing video character codes, character generator means and cell generator means both being coupled from the output of the video memory means in a common to a shift register. The shift register has associated therewith controls for the loading thereof and for the shifting of signals therefrom. Control signal means are provided having a video inverting and a video non-inverting state. At the output of the shift register, there is preferably provided output gating means. The aforementioned control signals couple to the output gating means for providing either inversion or non-inversion of the signal to the output gating means from the shift register. Depending upon the state of the control signal, the character information is either inverted or not inverted.

8 Claims, 17 Drawing Sheets

LOWER NUMBER IS FOR PACKAGE
Z80 IS A 40 PIN DEVICE PLACED IN UPPER 40 PINS OF A 48 PIN SOCKET
HIGHER NUMBER IS FOR SOCKET
Z80 U57
U56 74LS 244
U55 74LS 244
U68 FIG. 1B
U71 FIG. 1B
J6 SEE FIG.6
FIG.4 INT
FIG.4 NMI
FIG.4 & 6 RESET
FIG.4 FIG.6 WAIT PWAIT
FIG.2 FIG.2 EXTMEM A16
PCLK FIG.6
PCLK FIG.6
C22 33uf
R27 220Ω
R25 1.2K
2N3906 Q3
R61 33Ω
RP2 4.7K
RP2 470Ω
R22 100K
R24 750Ω
C20 22uf
C21 .022 uf
C32 .022uf
CR1 IN4148
U17
U46
RP2 47K
BUSRQ
INT
NMI
RESET
WAIT
CLOCK
GND
M1
IORQ
RD
WR
MREQ
HALT
BUSAK
RFSH
PM1
PIOREQ
ZRD
ZWR
PMREQ
EN1
EN2
+5V
NC

ADDRESS BUS 24
74157 U63
74157 U76
CATHODE RAY TUBE CONTROLLER
MC6845 U47
74LS 244 U64
RAM DATA BUFFER
RAM ARRAY
EITHER ← 16 K → OR ← 64K →
DATA BUS 18
THE ABOVE ARRAY CONSISTS OF 16 IC's WITH THE INPUTS ON TOP PARALLELED TO ALL CHIPS; INPUTS 8,15,9 & 1 ARE PARALLELED TO EACH BANK OF 8 ON THE BOTTOM

CTRC/CPU ADDR MUX 74LS157 U33
CTRC/CPU ADDR MUX 74LS157 U34
CTRC/CPU ADDR MUX 74LS157 U35
4016 2K X 8 RAM U21 VIDEO RAM
74LS 273 U8 VIDEO OUT LATCH
U7 74LS373 VID DATA READ LATCH
U6 74LS244 VID DATA WRITE BUFFER
VSYNC
HSYNC
DISENB
INCHAR
CRT CLK
MAD Ø
WE
INVVIDE
RA3
GRAPH
CHAR
LATCH DAT
VIDEO
MRD
VBON
LOAD
REF. 50,52 FIG.3C
REF. 98 FIG.3C
CHAR FIG.3C

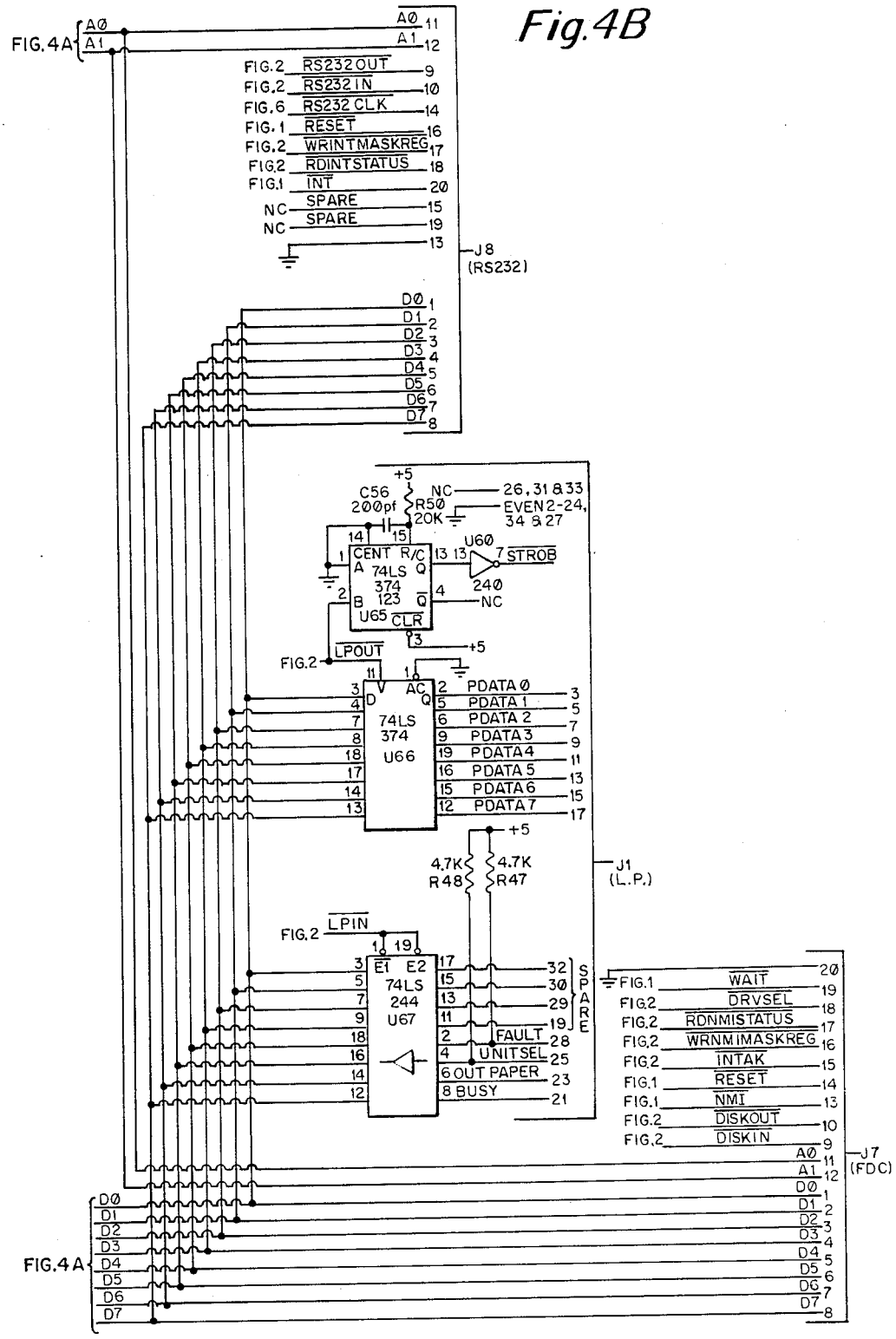
Fig.4B
FIG.4A
A0
A1
FIG.2 RS232OUT
FIG.2 RS232IN
FIG.6 RS232CLK
FIG.1 RESET
FIG.2 WRINTMASKREG
FIG.2 RDINTSTATUS
FIG.1 INT
NC SPARE
NC SPARE
J8 (RS232)
D0
D1
D2
D3
D4
D5
D6
D7
+5
C56 200pf
R50 20K
NC
26,31 & 33
EVEN 2-24, 34 & 27
U60
STROB
240
CENT R/C
74LS 374 123
U65
CLR
LPOUT
FIG.2
74LS 374 U66
PDATA 0
PDATA 1
PDATA 2
PDATA 3
PDATA 4
PDATA 5
PDATA 6
PDATA 7
4.7K R48
4.7K R47
J1 (L.P.)
LPIN
E1 E2
74LS 244 U67
FAULT
UNITSEL
OUT PAPER
BUSY
SPARE
FIG.1 WAIT
FIG.2 DRVSEL
FIG.2 RDNMISTATUS
FIG.2 WRNMIMASKREG
FIG.2 INTAK
FIG.1 RESET
FIG.1 NMI
FIG.2 DISKOUT
FIG.2 DISKIN
J7 (FDC)

+5
R28
4.7K
R36
4.7K
U27
74
NC
R35
7.5K
R34
1.2K
+12
IN914
CR10
2N2222
Q4
CR9
IN982
IN982
CR8
J3

FIG.2 RDINTSTATUS
R45
4.7K
367 U38
FIG.2 CASS OUT
R29
220K
220Ω
R37
FIG.2 MOD OUT
74LS
174
U42
MODSEL
ENALTSET
ENEXTIO
DISWAIT
FAST

NC
FIG.2 ENCASINTFALL
FIG.2 ENCASINTRISE
FIG.2 CASSIN
U39
U54
U14
U61
U15

D0
D1
D2
D3
D4
D5
D6
D7

U41
74LS
244
R52
4.7K
U40
R8
4.7K
R10
620K
CR2
IN4148
R14
10K
R15
51K
R9
10K
LM339
R33
R16
10K
C17
.1
C30
.0047
U28

FIG.2 CASSIN
FIG.2 CASS OUT
U54
240
PAST
R46
4.7K
FIG.2 RDINTSTATUS
U53
FIG.3 VSYNC
U51
32
U52
U38
367
U61

FIG.2 RTCIN
FIG.2 ENRTC

J10
GRAPHICS
J11
WAIT
RESET
A2
A1
A0
D0
D1
D2
D3
D4
D5
D6
D7
HSYNC
VSYNC
DISENB
ENGRAF
GRAPVID
J
DCLK
GSEL1
GSEL2
IORQ
H
I
I IN
DLYDCLK
CLKL
GEN
E14
E15
SEN
U16
U46
U19
U20
U30
U32
U31
LS14
U33
U21
U22
U12
U25
U52
U62
U18
4.7K
R60
504
64/B0
B0/64L
PM1
FAST
PRECHG
PCLK
XADR7
ZWR
ZRD
VIDEO
ACCESS IN PROGRESS
PWAIT
CRTCLK
MWR
OE
WID
WE
VBON
SMUX
ICAS
LATCHDAT
RAS
MCYCEN
MREQ
PRECHG
NC 110
114
115
116
118
120
122
124
126
128
130
134
136
138
139
140
36
34

DETAIL "A"
FROM FIG. 4

THE ABOVE KEYS (THE NUMERIC KEYPAD) ARE CONNECTED IN PARALLEL WITH SIMILAR KEYS OF THE KEYBOARD MATRIX.

VIDEO DISPLAY GENERATOR HAVING ALTERNATE DISPLAY MODES

This application is a continuation of application Ser. No. 488,743, filed 4-26-83 now abandoned.

BACKGROUND OF THE INVENTION

The present invention relates to a video controller preferably for use in a microcomputer system. The video controller controls the video display and is capable of both character generation control and cell generation control.

It is an object of the present invention to provide an improved video controller circuit, preferably for use in a microcomputer system and which enables character inversion.

Another object of the present invention is to provide an improved video controller as in accordance with the preceding object and which permits video inversion under such control to provide inversion on a character-by-character basis.

Still a further object of the present invention is to provide an improved video controller which employs as the heart of the controller, a cathode ray tube controller for coupling signals to a video RAM of the video controller.

A further object of the present invention is to provide an improved video controller in accordance with the preceding objects and which has means for controlling the output video signal to provide graphic overlay.

Another object of the present invention is to provide an improved video controller in accordance with the preceding objects and which has control for enabling, in addition to character generation and cell generation, alternate set control preferably by way of the system character generator ROM.

SUMMARY OF THE INVENTION

To accomplish the foregoing and other objects of this invention, there is provided a video controller, preferably for use in a microcomputer system. This video controller basically receives data from a system memory such as a random access memory. Address data is presented to a video memory means which is adapted to store video character codes. The video controller also comprises character generator means and means coupling the output of the video memory means to the character generator means. The character generator means is adapted to provide data signals for display of characters. For example, the input data to the character generator may be in ASCII form and the outputs from the character generator are in the form of a set of parallel signals indicative of a line of a character at a time. A shift register couples from the output of the character generator and means are provided for loading the data signals into the shift register in parallel and for shifting the signals therefrom in serial. In accordance with the invention, output gating means are provided and means are also provided for coupling the output of the shift register to the output gating means. In order to provide signal inversion, there is provided signal control means having video inverting and video non-inverting states. Means couple the control signal means to the output gating means to provide one of inversion or non-inversion of the signal to the output gating means, which signal has been coupled from the shift register. The aforementioned control signal means preferably includes circuit means having one state indicating inversion and another state indicating non-inversion of the character. This control is provided selectively on at least a character-by-character basis. The aforementioned output gating means preferably includes a logic gate having a signal input for receiving the serial shift register signal and also having a control input for receiving the control signal from the control signal circuit means. The logic state that is provided herein is disclosed as an exclusive OR gate that enables the character inversion. The means that couple the output of the shift register to this output gate preferably comprises an AND gate means having one input for receiving the shift register serial output. With regard to this AND gate, there is also provided associated therewith a blanking signal which is coupled to the other input of the AND gate. This blanking signal enables blanking of the screen between character rows.

The video RAM couples to the character generator, preferably by way of an output data latch. The data lines between the data latch and the character generator do not all connect directly, but instead there is also provided logic control referred to herein as alternate set logic means for controlling data flow content from the data latch to the character generator. The alternate set logic means includes gate means responsive to an alternate set enabling signal and at least one data bit from the data latch means. This gate means preferably includes an OR gate responsive to the alternate set enabling signal or a first data bit. The gate means also includes preferably an AND gate means having one input connected to the OR gate means, a second input from a second data bit, and the output coupling to the character generator at a position corresponding to the second data bit.

In accordance with the invention there is also provided in the disclosed embodiment, a cell generator means and means coupling this cell generator means in parallel with the character generator means. The cell generator couples in common at its output with the character generator and both devices are coupled to the parallel inputs of the shift register. The cell generator preferably comprises a multiplexer and a video data output buffer. Now, associated with the character generator and cell generator is logic means including a first logic gate responsive to a first data bit signal from the video memory means for providing a signal, the state of which is representative of either graphic generation or character generation. To provide this control, there is provided a flip-flop coupled from this first logic gate and having alternate states including one state enabling only the character generator means and another state for enabling only the cell generator means. This first logic gate preferably comprises an AND gate. The aforementioned control signal means responsible for character inversion may be considered as comprising a second logic gate having one input for receiving an inverse video enable signal and a second input for receiving a data bit.

In the disclosed embodiment, as the heart of the system, there is provided a cathode ray tube controller which receives data inputs from a system databus. The output of the cathode ray tube controller couples to the video memory. The cathode ray tube controller is coupled to the video memory by means of multiplexers which have two sets of different inputs. In the disclosed embodiment, there are three quad input multiplexers. These multiplexers each have a first set of inputs, coupled from a cathode ray tube controller, and a second set of inputs coupled from the central processing unit address bus.

BRIEF DESCRIPTION OF THE DRAWINGS

Numerous other objects, features and advantages of the invention should now become apparent upon a reading of the following detailed description taken in conjunction with the accompanying drawing, in which:

FIGS. 4A and 4B show additional timing for the system including keyboard circuitry.

DETAILED DESCRIPTION

The video controller of the present invention is preferably adapted for use in a microcompuer which may be of the self-contained desk-top microcomputer type. The microcomputer system includes a microprocessor such as the conventional Z-80 microprocessor shown in FIG. 1A which in the microcomputer system of the present invention is capable of running at either of two different clock rates. It also included preferably two programmable array logic (PAL) circuits used for frequency division and routing of appropriate timing signals.

The computer system is provided with main CPU timing from a 20-MHz. clock. Of the aforementioned PALS, a first PAL U3 (see FIG. 6B) divides the main clock signal by five to provide 4 MHz. CPU operation. The main clock is also divided by ten to provide a 2 MHz. rate. The logic also waits the CPU at 4 MHz. clock rate for the M1 cycle. The first PAL U3 also divides the master clock by four to obtain a 5 MHz. clock to be sent to the RS-232 option connector as a reference for the band rate generator. The second PAL U4 (see FIG. 6B) selects an appropriate 10 MHz. or 12 MHz. clock video shift clock, and by means of a divider U5, provides additional timing signals to the video display circuitry to be described in further detail hereinafter.

Low level signals from and to the CPU need to be buffered or current amplified in order to drive many other circuits. The 16 address lines are buffered by devices U55 and U56 shown in FIG. 1A, which are uni-directional buffers that are permanently enabled. The eight data lines are buffered by device U71 (see FIG. 1B). Since data must flow both to and from the CPU, the device U71 is a bi-directional buffer which can go to a three state condition when not in use. Both direction and enable controls come from the address decoding section.

Figure 1A:
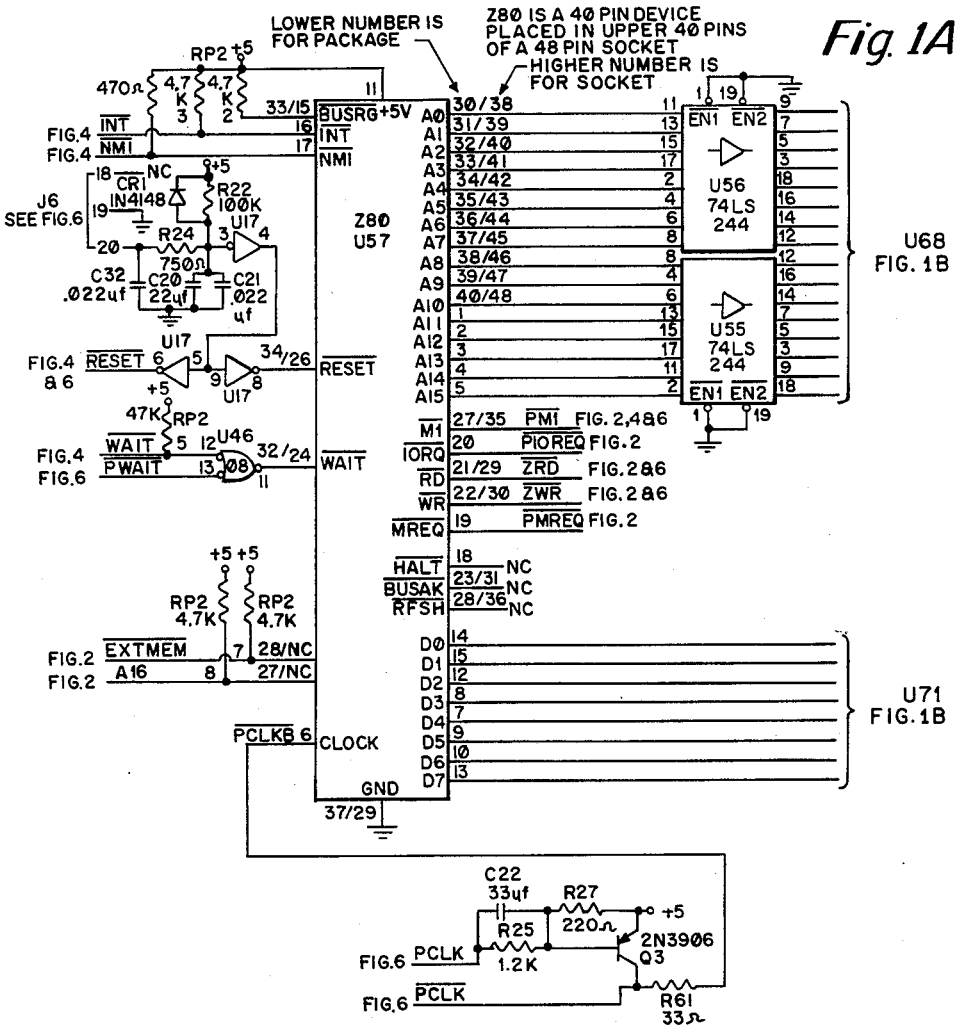
FIGS. 1A and 1B show one portion of the microcomputer system including the basic Z80 processor.

In FIG. 1A, the clock signal to the CPU is buffered by the active pull-up circuit Q3. The RESET and WAIT inputs to the CPU are buffered by gates U17 and U46. Control outputs from the Z80 processor include the signals M1-, RD-, WR-, MREQ- and IORQ-. These signals are sent to the PAL U58 shown in FIG. 2 which combine these into other appropriate control signals. Other than the signal MREQ- which is buffered by device U38, the raw control signals go to no other components and hence require no additional buffering.

Figure 2A:
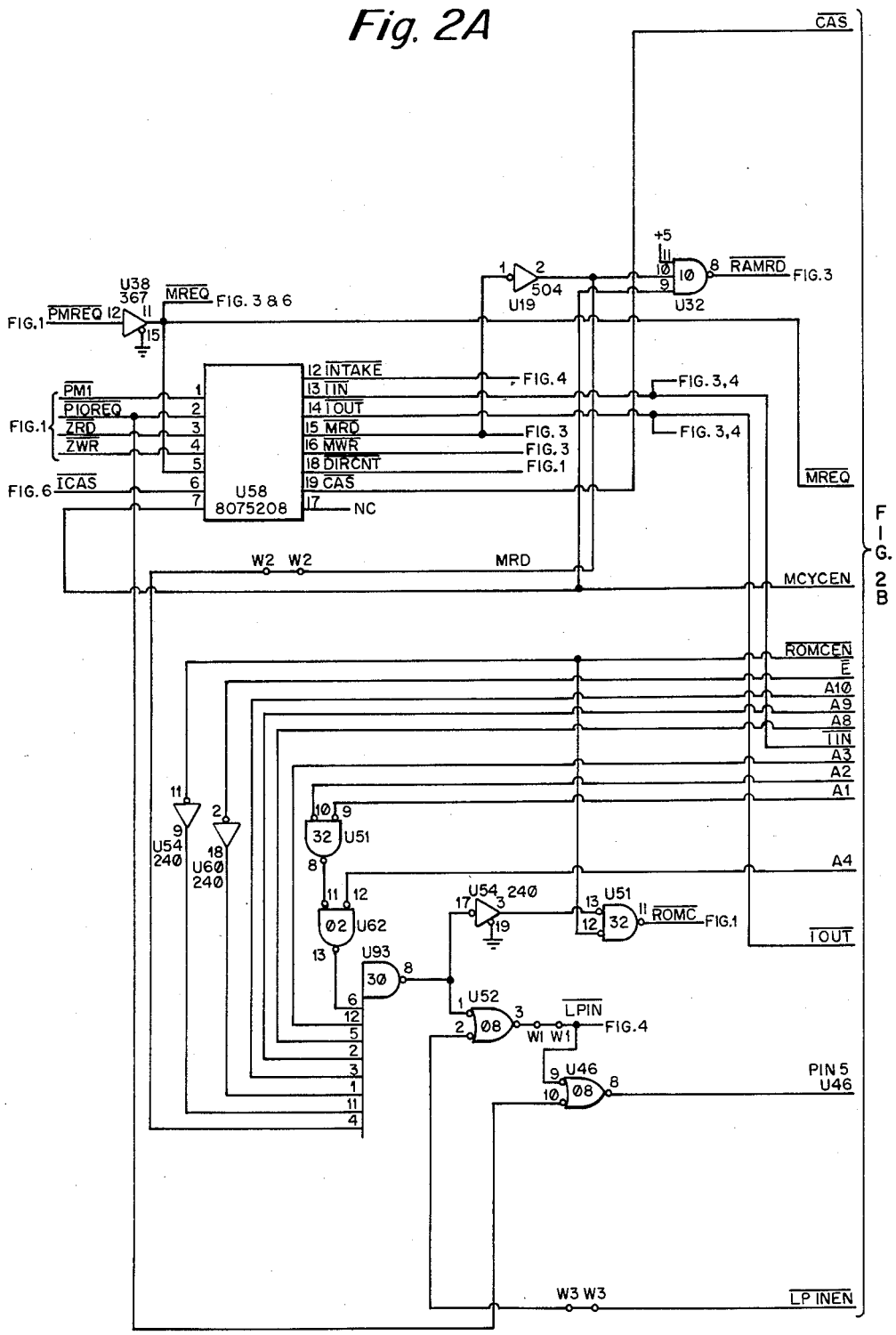
FIGS. 2A, 2B, and 2C show a portion of the microcomputer system including a programmable array logic (PAL) circuits and decoders used in generating timing signals used in the system.
Figure 2B:
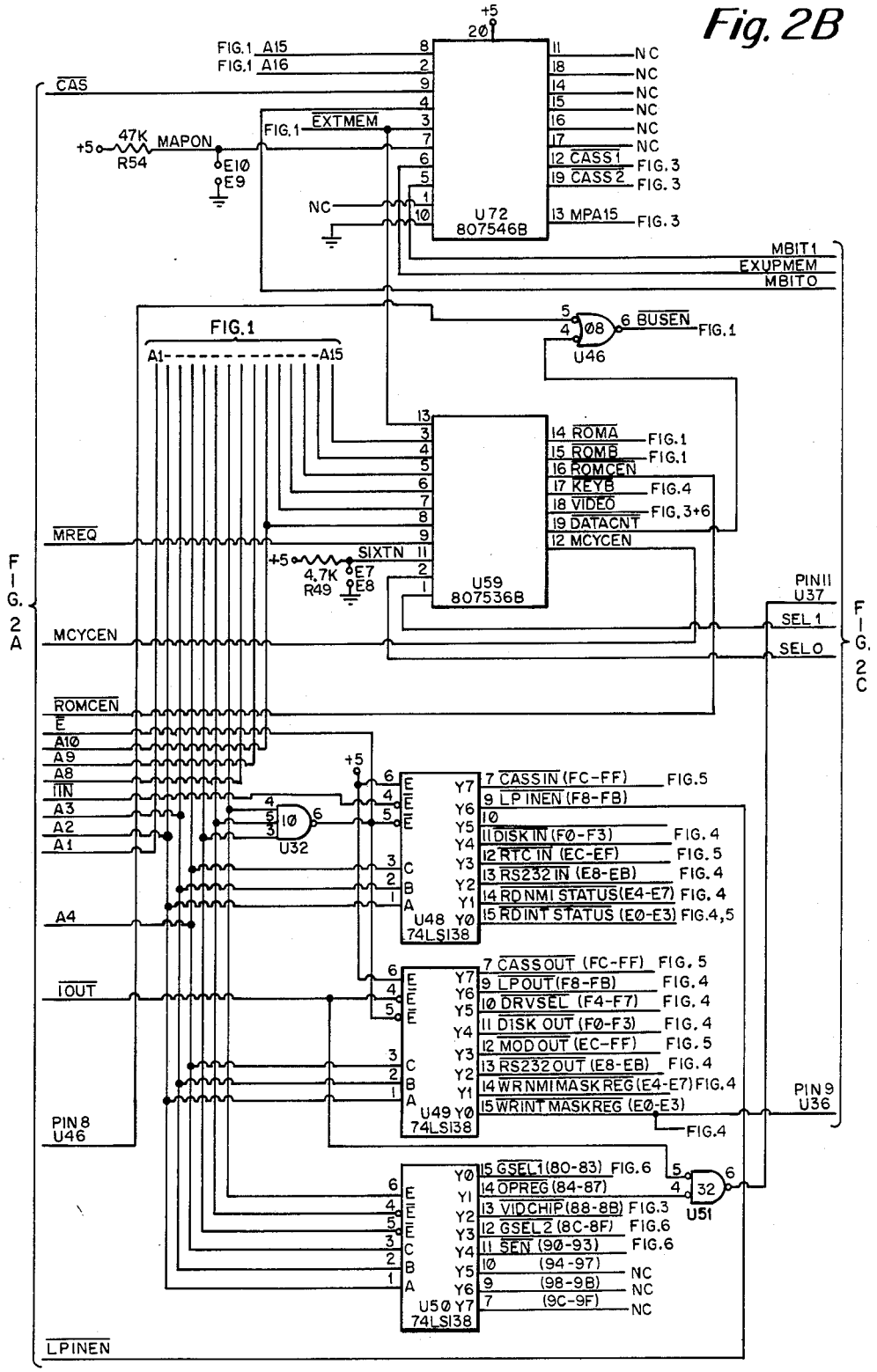
Figure 2C:
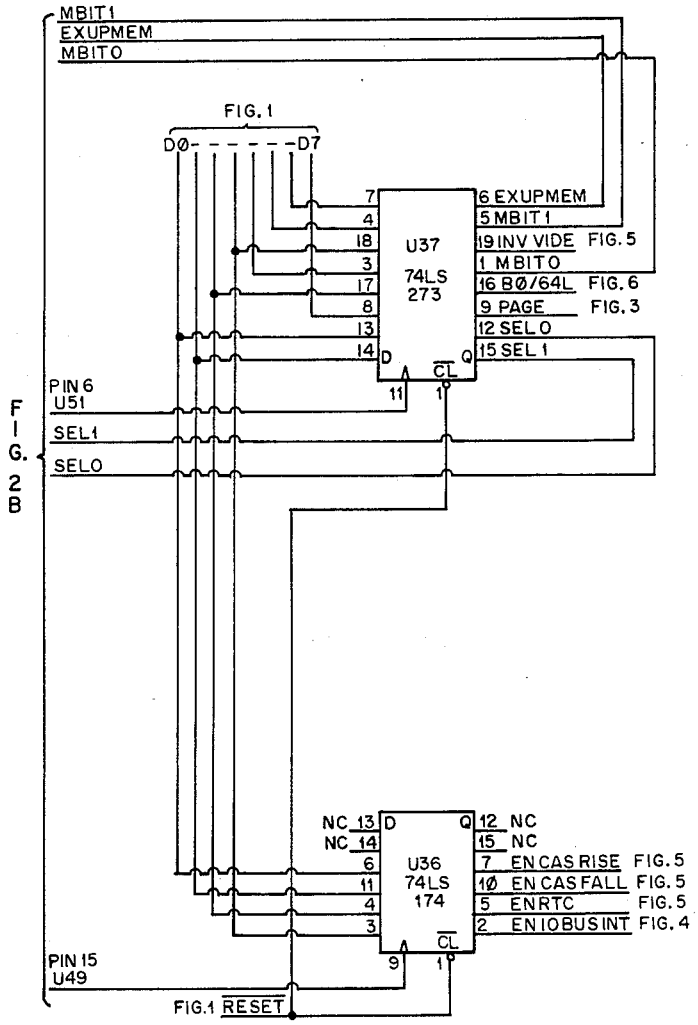

The address decoding section is divided into two sub-sections, namely port address decoding and memory address decoding. In port address decoding, lower order address lines are sent to the address and enable inputs of decoder U48, U49 and U50 (see FIG. 2B). The decoder U48 is also enabled by the signal IN-, which means that it decodes port input signals, while decoder U49 decodes port output signals. Memory mapping is accomplished by the PAL U59 shown in FIG. 2B in the basic 16K or 64K system. In a 120K system, the PAL U72 along with the select and memory bit of the option register, also enter into the memory mapping function.

Figure 1B:
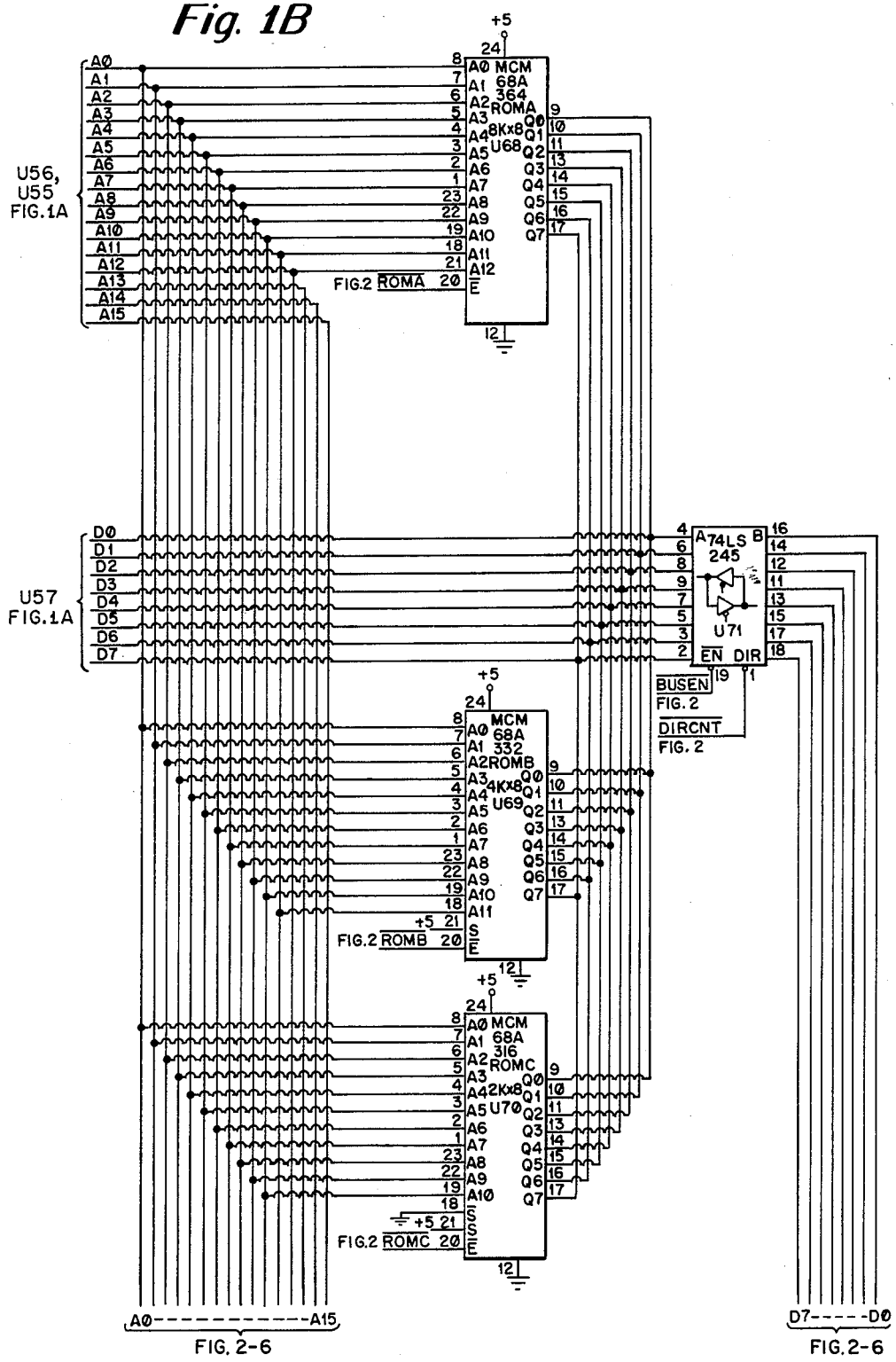

Another component of the microcomputer system is the read-only memory (ROM) shown in FIG. 1B. In the microcomputer system, the ROM is preferably of 14K capacity divided into an 8K ROM, a 4K ROM and a 2K ROM. The ROMS that are used preferably have three-state outputs which are disabled if the ROMS are deselected. ROM data outputs are connected directly to the CPU databus. The ROMS contain a basic operating system, as well as a floppy disk boot routine.

In the overall microcomputer system, the random access memories are available as options in three different capacities including 16K, 64K or 128K of RAM. The 16K option uses memory type 4116. The 64K and 128K options which are described in detail herein use memory type 6665. This type is of 64K by 1 capacity requiring only a single supply voltage.

Figure 3A:
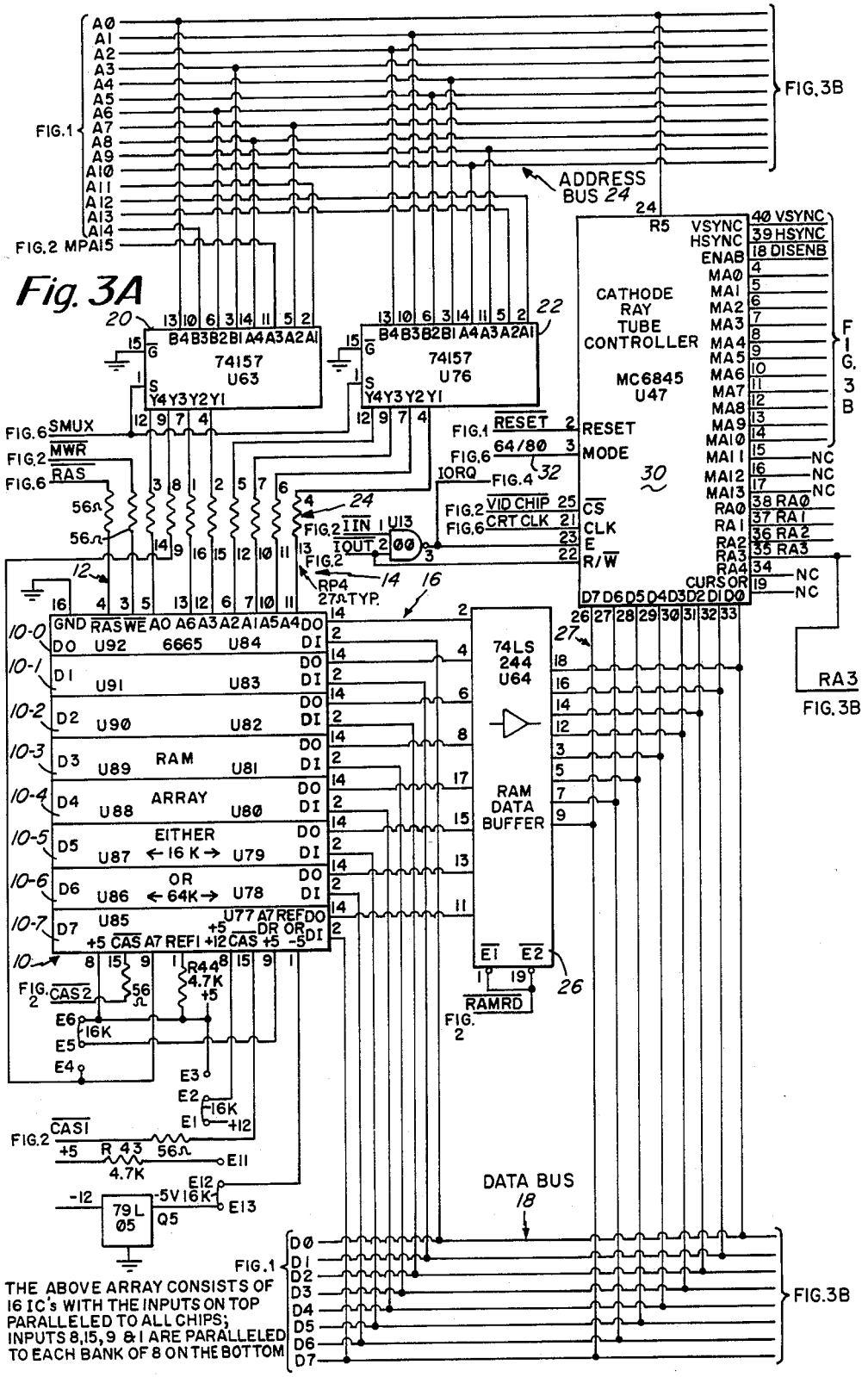
FIGS. 3A, 3B and 3C show video circuitry along with the system random access memory and cathode ray tube controller.

Now, with regard to the drawing, there is shown in FIG. 3A random access memory 10 which is comprises of eight memory units 10-0, 10-1, 10-2, 10-3, 10-4, 10-5, 10-6 and 10-7. Each of these memory units as mentioned previously is of type 6665 having associated therewith input control lines such as lines 12, address lines 14 and output data lines 16. The data outputs from the RAM 10 couple to the databus 18. The databus is identified by the signals D0–D7.

A dynamic RAM as used herein requires multiplexed incoming address lines. This is accomplished by means of circuits 20 and 22. These circuits are each of type 74157 referred to as quad-multiplexers. The four output lines from the multiplexers 20 and 22 connect by way of a resistor array 24 to the address inputs of the RAM. The inputs to the multiplexers 20 and 22 are taken from the address bus 24. The address bus 24 is designated by address lines A0–A15 as noted.

The random access memory 10 is of conventional design in a readily available circuit chip and has signals coupled thereto such as memory read-write signals and memory request signals. Reference has been made hereinbefore to control lines 12. These include a memory read-write signal (MWR) and a row address strobe signal (RAS). There is also provided as shown at the bottom of the RAM 10 a column address select (CAS).

The data lines 16 from the RAM 10 are coupled to the RAM data buffer 26. This buffer may be of type 74LS244 referred to typically as a octal buffer. The output of the RAM data buffer 26 couples to the databus and cathode ray tube controller 30. For the 128K RAM option, there are two rows of the 64K by 1 RAM circuits type 6665. The proper row is selected by the signal CAS- shown in the drawing and generated from a programmable array logic (PAL) circuit U72 (see FIG. 2B). The output data lines 27 from the RAM data buffer 26 couple as data signals D0–D7 to the cathode ray tube controller (CRTC) 30. The controller 30 is in a sense the heart of the video display circuitry. This controller is of type MC6835. The controller 30 allows two screen formats; 64 by 16 and 80 by 24. Since the 80 by 24 screen requires 1,920 screen memory locations, a 2K by 8 static RAM is used for the video RAM. The 64 by 16 mode has a two-page screen display and a byte in the options register for determining which page is active for the CPU. One offsets the start address of the controller 30 to gain access to the second page 64 by 16 mode. In this connection, note the input control signal on line 32 which is a mode control signal controlling either 64 by 16 or 80 by 24 operation.

Figure 3B:
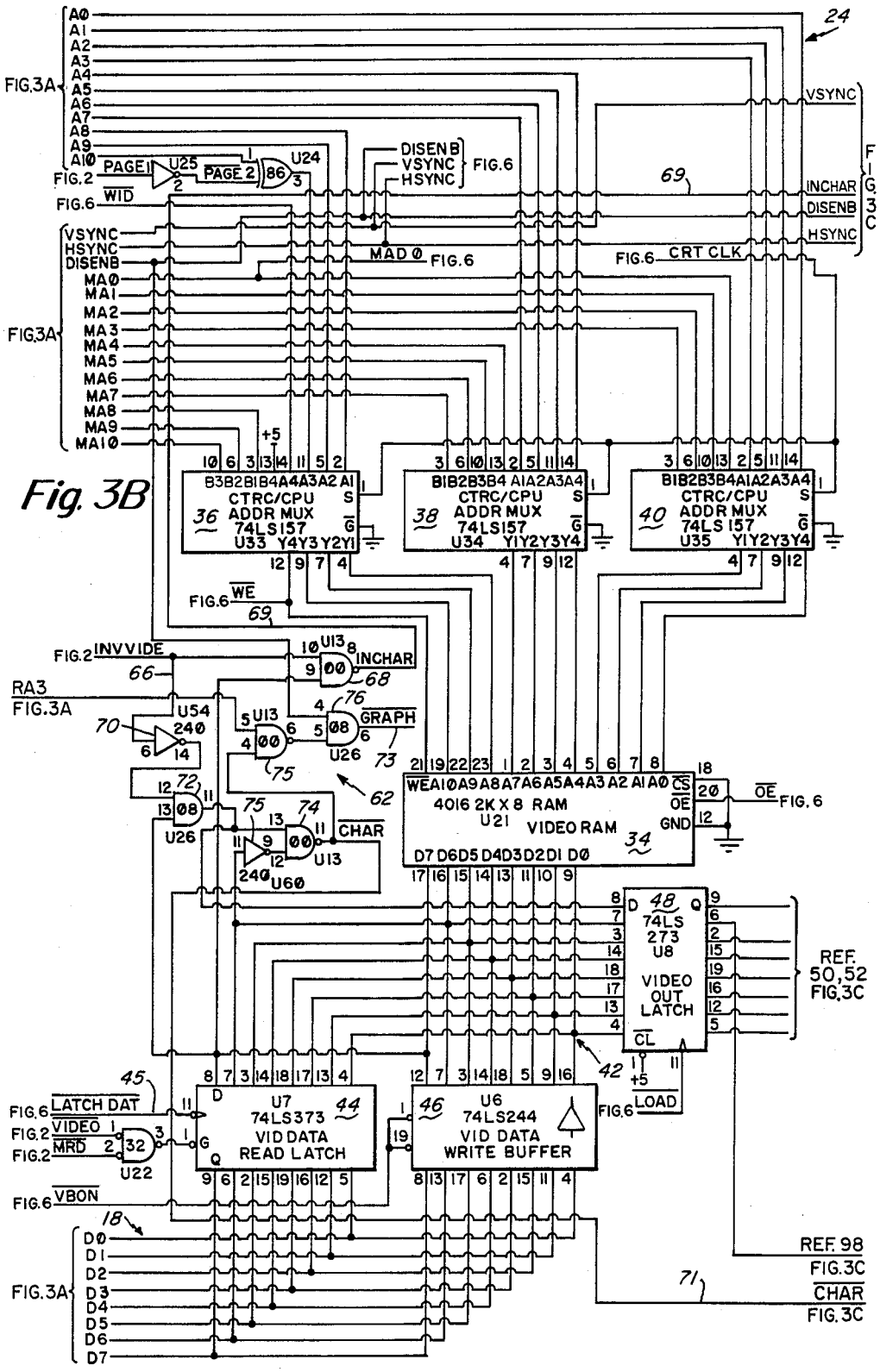

The controller 30 as mentioned previously is a conventional circuit that generates all of the necessary timing and control signals associated with video control including addresses for the video RAM 34 (see FIG. 3B). The video RAM 34 is of type 4016 and is a 200 nanoseconds RAM of capacity 2K by 8. This is a static RAM. It is noted that the address lines from the controller 30 are coupled in groups to three address multiplexers 36, 38 and 40 (see FIG. 3B). These multiplexers are controlled by the CRT clock signal (CRTCLK). Thus, addresses to the video RAM 34 are provided from the controller 30 when the screen is being refreshed and are provided directly from the CPU by way of the address bus 24 when updating the screen data. This alternate control is controlled by the signal CRTCLK which is a bi-level signal that controls the operation. This signal CRTCLK is coupled to pin 1 of each of these multiplexers. Each of the multiplexers 36, 38 and 40 is referred to as a quad multiplexer of type 74S157. The data lines of the video RAM 3 may be referred to as a video databus 42. This video databus intercoupless the video RAM with a video data read latch 44, a video data write buffer 46, and a video output latch 48. The video data read latch 44 is an octal latch of type 74LS373. The video data write buffer 46 is a octal buffer of type 74LS244. The video output latch 48 is an octal flip-flop circuit of type 74LS273. The data transfer between the CPU and the video RAM 34 is latched by the video data read latch 44 whose output connects to the databus 18. Input data passes to the video data write buffer 46 from the databus 18 to the video RAM.

During a screen refresh, the data outputs of the video RAM 34 are latched by the video output latch 48. The outputs from the video RAM 34 are ASCII character codes. These data outputs becomes the addresses for the character generator ROM 50 (see FIG. 3C). The character generator ROM 50 may be of type MCM68A316E. In accordance with the system described herein, there is also provided an alternate display in the form of low resolution graphics. Accordingly, there is provided a data selector 52 and associated video data output buffer 54. The selector 52 may be in the form of a dual multiplexer of type 74LS153. The video data output buffer 54 may be a octal buffer of type 74LS244. The multiplexer or selector 52 receives the data signals from the video output latch and provides two control signals which are coupled in common separately to the video data output buffer 54.

The output of the character generator ROM 50 and the video data output buffer 54 couple in common to the shift register 56 which may be of type 74LS166. There are control inputs associated with the shift register 56 for loading data into the shift register, and shifting data on a clocked basis out of the shift register. The line 58 is the basic video output from the shift register 56.

The inputs to the shift register 56 are the latched data outputs from either the character ROM 50 or the cell generator at the video data output buffer 54. The shift clock input on line 57 is a timing signal generated from PAL U4 and is at a frequency of 10.1376 MHz. for the 64 by 16 mode and at a frequency of 12.672 MHz. for the 80 by 24 mode of operation. The serial output from the shift register on line 58 after signal processing to be described hereinafter, becomes the actual video dot information shown at the video output line 59.

Special timing considerations in the video circuitry are handled by means of the latch 60. The latch 60 may be a quad flip-flop of type 74LS175. In this regard, it is noted that there are four input data lines and four pairs of output lines including assertion and negation outputs. This timing or synchronization provided by the latch 60 includes a blanking control originating from the controller 30 and shift register clocking originating from a PAL of the microcomputer system. In accordance with the present invention, additional video control and timing functions, such as sync buffering, inversion selection, dot clock chopping, and graphics disable of a normal video, are handled by logic gating shown on the drawing and to be soon described.

Figure 3C:
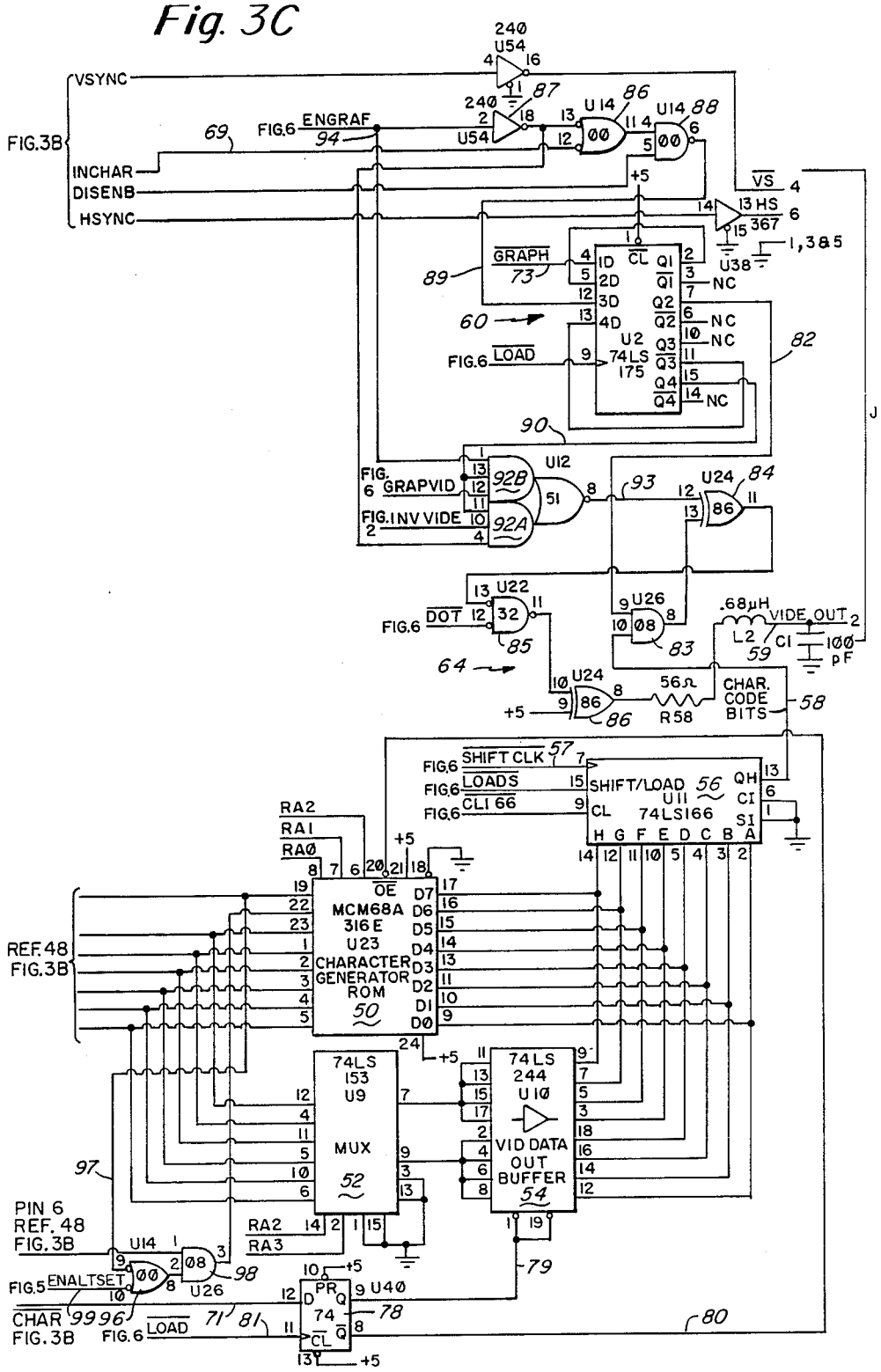
Figure 4A:
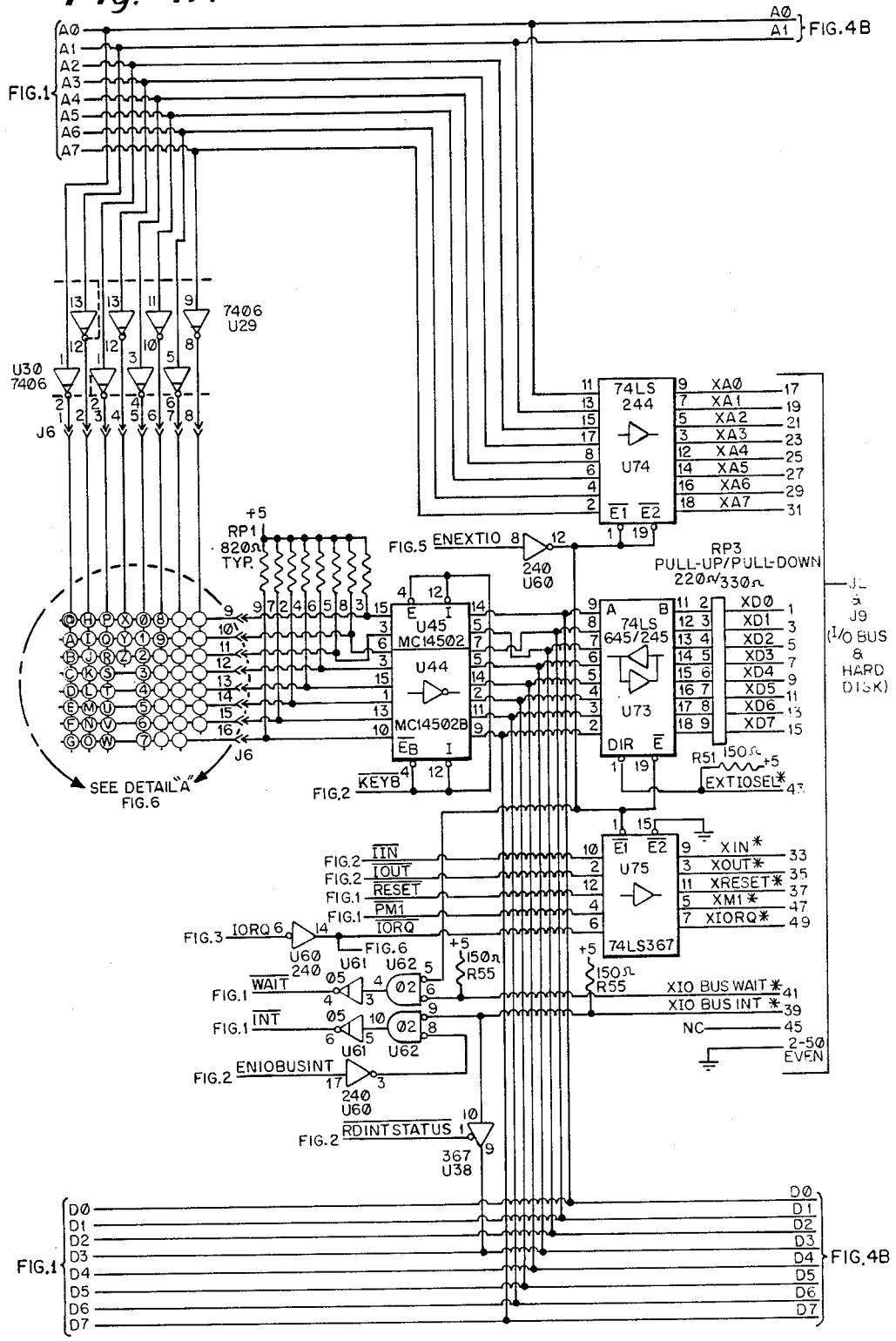

In the drawing, there are two sets of logic including set 62 (FIG. 3B) and set 64 (FIG. 3C). Logic set 62 controls, inter alia, the forementioned video inversion. In this regard, note the signal INVVIDE (inverse video) on line 66 which couples to NAND gate 68 and also inverter 70. The output of the inverter 70 coupled to an AND gate 72. The output of the AND gate 72 in turn coupled to a NAND gate 74. The logic set 62 also includes NAND gate 75 and AND gate 76.

When the mode of operation is not an inverse video, then the line 66 is low and an enabling signal is coupled by way of the inverter 70 to the AND gate 72. The other input to the gate 72 is the dataline D7. It is noted that this also couples to one input of the NAND gate 68. The logic set 62 also receives the dataline signal D6 which it is noted is coupled by way of inverter 75 to one input of the NAND gate 74. The output of the gate 74 by way of line 71 couples to a control flip-flop 78 (See FIG. 3C). The flip-flop 78 has its assertion output coupled by way of line 79 to the buffer 54 and has its negation output coupled by way of line 80 to the character generator ROM 50. These outputs of the flip-flop couple to enable inputs of the buffer and ROM. A load timing signal is coupled to the clock input of the flip-flop 78. This signal is coupled on line 81. When the signal on line 71 is high, the flip-flop 78 is set and the low output on line 80 enables the character generator. Alternatively, when the signal on line 71 is low, this causes a resetting of the flip-flop 78 upon occurrence of the clocking thereof and this causes a low signal on the line 79 for enabling the cell generator section by directly enabling the video data output buffer 54.

In accordance with the present invention, there is provided for an inversion of the video (black-to-white and white-to-black). In this connection, refer to the inverse video signal on line 66. When the system is not in the inverse mode of operation, the signal on line 66 is low. This signal is inverted by inverter 70 and couples to the AND gate 72 to enable the gate 72. Assuming that the dataline D7 is also at its high state, then the output of the AND gate 72 is also high. The output from the gate 72 couples to two different locations. This signal couples directly to the video output latch 48 so as to provide, in normal, non-inverted operation, all eight data bytes from the video output latch 48 to the character generator 50. The signal from the gate 72 also couples to the NAND gate 74. Now, the data line D6 which couples to the inverter 75 has its state establish whether one is generating graphics or characters. For graphics the data bit D6 is low and for characters the data bit D6 is high. Assuming that the data bit D6 is low for graphics, then the inverter 75 causes two high inputs to occur at the gate 74 thus causing a low output therefrom. The output from the gate 74 couples to two different places. The output of this gate couples by way of the aforementioned line 71 to the flip-flop 78 and this output from gate 74 also couples to NAND gate 75. This low level signal at the output gate 74 provides a high signal at the output of gate 75 and also a high at the output of gate 76. The output of gate 76 at line 73 is shown coupling to the latch 60. The latch 60 forms a synchronizer providing predetermimed delays so that all operations on the character are synchronized at the output video. The signal on line 73 entering the latch 60 is delayed at the output line 82. This signal couples to the AND gate 83. The AND gate 83 also receives on its line 58 the direct character code bits from the shift register 56.

Now, as mentioned previously, the output of gate 76 is high and this high level signal, delayed by the latch 60 is coupled to the gate 83. This forms an enabling signal so that the character code bits on line 58 pass directly through the gate 83 to the exclusive OR gate 84. The character code bits are capable of passing by way of the gate 84, by way of NAND gate 85 and inverter 86 to the output video line 59. The gate 85 has inverted sensing inputs. The gate 86 is shown as an exclusive OR gate but is logically an inverter having one of its inputs permanently connected to a voltage high. The output on the video line 59 is the dot pattern for generating graphics and characters on a line-by-line basis on the screen at a typical raster scan rate.

The low output from the gate 74 also couples by way of line 71 to the flip-flop 78 and upon clocking of the flip-flop, it is reset so that the output on the line 79 goes low thus enabling the video data output buffer 54 for enabling data transfer from the cell generator rather than the character generator. The high signal on line 80 from the flip-flop 78 causes a disabling of the character generator ROM 50.

Now, assuming that the data bit D6 is high which is to indicate character generation rather than graphics or cell generation, this signal is inverted by the inverter 75 providing a low input to the gate 74 which in turn is inverted by the gate 74 to provide a high output. This high output signal from gate 74 couples by way of line 71 to the flip-flop 78 so that upon occurrence of the next clock pulse at line 81, the flip-flop 78 is set, assuming that it had been previously reset. The setting of the flip-flop 71 causes a low signal on line 80 for enabling the character generator ROM 50. The signal on line 79 from the flip-flop 78 is high and disables the cell generation portion of the circuit or in particular it disables the video data output buffer 54.

The high output from the gate 74 also couples to the gate 75. The other input to gate 75 is the signal RA3 which is a row select signal from the cathode ray tube controller 30. This gate 75 is used for blanking to provide a blanking signal between character rows. Thus, when blanking is to occur, the signal RA3 is high and the output of gate 75 low. This low level signal is passed by way of line 73 to the latch 60. The delayed signal is coupled by way of line 82 to the gate 83. This low level signal inhibits the gate 83. Thus, the character code bits on line 58 coupled to gate 83 are blanked by virtue of this inhibit signal delayed so as to be properly synchronized by means of the synchronizing latch 60. In this connection, with regard to the latch 60, it is noted that a line intercouples the output of the first flip-flop at output Q1 to the data input 2D of the second flip-flop. It is the output Q2 from the second flip-flop of the latch that couples by way of the line 82 to the AND gate 83.

When the signal RA3 is not high, which is during a character space and not between characters, then the output of gate 75 is low and there is a low level signal coupled on line 73 by way of the first two stages of the latch 60 so that the signal on line 82, properly synchronized, is a high level signal which enables the gate 83 and permit passage of the character code bits from line 58 by way of gate 83 to the exclusive OR gate 84.

In this mode of operation just discussed it has been assumed that the signal on line 66 is low because there is not video inversion. It is noted that this low level signal coupled to the gate 68 maintains the output of the gate 68 at its high state. This signal couples by way of line 69 to one input of the OR gate 86. The inputs to the OR gate are inversion inputs. Associated with the gate 86 is also an inverter 87 and a NAND gate 88. It is noted that the output of the NAND gate 88 couples by way of line 89 to the two latter stages of the latch 60. Line 89 couples to the 3D input of the latch. It is noted that the Q3- output from the latch couples back into the fourth date input 4D and the output at Q4 couples by way of line 90 to gate 92.

The inputs to gate 86, look for low level signals. Thus, when the signal on line 69 is at its high level and when one is not enabling external graphics, then the output of the gate 86 is low. This low level signal is inverted by the gate 88 to a high level signal on line 89. A further inversion occurs in the latch 60 and thus the signal on line 90 is low, thus disabling both sections of the combination AND and NOR gate 92.

Thus, when the output of gate 68 is high because we are not in inverse video, the signal on the line 69 is essentially an inhibiting signal. However, for video inversion, the signal on line 66 goes to its high state. First, this signal couples by way of gate 70 to AND gate 72 to inhibit the gate 72 so that it has a low output. This low output is coupled to the video output latch 48 so that the data bit D7 is always at a low state. This low level signal also couples to gate 74 so as to provide a high output from gate 74. This high output signal from gate 74 couples on line 71 to cause a setting of the flip-flop 78. In this state, the line 80 is low and thus the character generator is enabled. The high level signal from NAND gate 74 also couples to the NAND gate 75 and provides operation as previously mentioned for providing blanking between character rows. As indicated previously, this is under control of the signal RA3 from the cathode ray tube controller 30.

The inverse video signal on line 66, when at its high state, also couples to gate 68 and assuming that the other input to the gate 68 is also high, then the output from 68 goes low. This low going signal on line 69 is indicative of character inversion. This signal is coupled to gate 86 for causing a high output therefrom which is inverted by gate 88 as long as the display enable signal is present at the other input of the gate. This provides a low output signal from the gate 88 which couples to the 3D input of the latch 60. It is noted that the interconnection from the third to the fourth stage is taken at the negation output Q3- and thus the output at line 90 is a high level signal coupling to the gate 92. for causing enabling thereof. However, it is only the lower gate 92A that is enabled because the inverse video signal is present and also the graphics is not enabled and thus the output from gate 87 is high. The enabling of gate 72 provides a low output therefrom which couples to one input of the exclusive OR gate 84. Thus, in the video inversion mode of operation, the signal on line 93 is low whereas for non-inversion, this signal is high. This has the effect of inverting the character code bits at the output of gate 83. Under non-inversion conditions, the line 93 is high and for inversion the line 93 goes low.

The latch 60 (FIG. 3C), as mentioned previously, is used primarily for synchronization and it is noted that there is a delay provided between the output of the gate 88 and the signal on line 90 coupled to the gate 92. This allows for the proper synchronization between the data presented to the shift register and the occurrence of the inversion signal.

In the drawing there is also shown the signal ENGRAF on line 94 (see FIG. 3C). This signal couples directly to the gate 92B and also by way of the inverter 87 to the gate 92A. When external graphics is being enabled the character code bit from gate 83 are essentially overlayed by means of an input graphic control signal referred to as the signal ENGRAF. When this is present, the gate 92B is enabled instead of the gate 92A and as long as the signal GRAFVID is present, then there may be a low signal on line 93 for providing inversion. This type of control is possible on a character-by-character basis or bit-by-bit (cell-by-cell) basis.

There are also provided, two other gates identified as OR gate 96 having inverted inputs and AND gate 98. One input to the gate 96 is the data line D7. The other input to the gate 96 is the signal ENALTSET on line 99. When this signal on line 99 is present, this signals the generation of an alternate character set from the character generator ROM. The alternate character set provides additional characters above the normal characters that are used. In this connection, when the inverse video signal is high, bits 0–127 represent normal characters, and bits 128–255 represent inverse video characters. If the inverse video signal is low and the alternate set signal is low, then bits 0–127 are normal characters, bits 128–191 are graphics and bits 192–255 represent a kana character set. If the inverse video signal is low and the alternate character set signal is high, then bits 0–127 are normal characters, bits 128–191 are graphics and bits 192–255 are alternate set characters.

When the signal on line 99 is absent, because an alternate set is not being enabled, then the output of gate 96 is high and this enables the gate 98. The gate 98 is enabled regardless of the state of the signal on the line 97 which is the date line D7. Thus, for normal character generation, the data bit D6 simply passes without inversion through the gate 98 to the corresponding D6 input of the character generator ROM 50.

When the signal on line 99 goes high to indicate an alternate set, then the control of the gate 96 is primarily from the line 97. If the date line D7 is high, then the output of gate 98 is low and thus the data bit D6 to the character generator is low. On the other hand, if the date bit D7 is low, then the data bit D6 from the output video latch simply goes directly by way of the gate 98 to the D6 input of the character generator ROM 50. Thus, for alternate set operation, the outcome is that the higher order data bits are presented to the character generator ROM 50 for display of what may be termed special characters.

Figures 1, 2, 3, 4, 6, 6A, 6B:
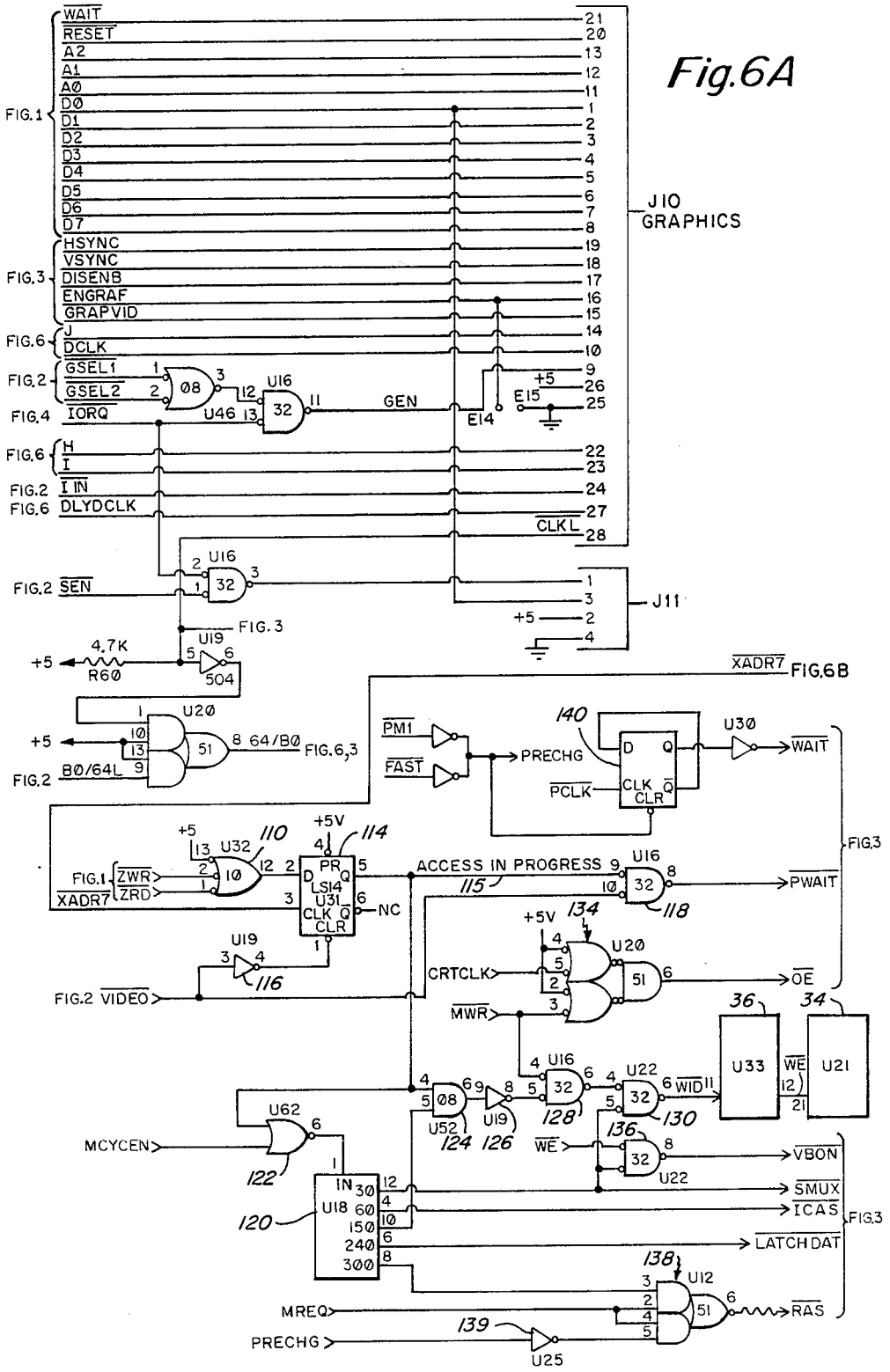
FIGS. 6A and 6B show a portion of the microcomputer system including video RAM and random access memory timing circuitry.
Figure 6B:
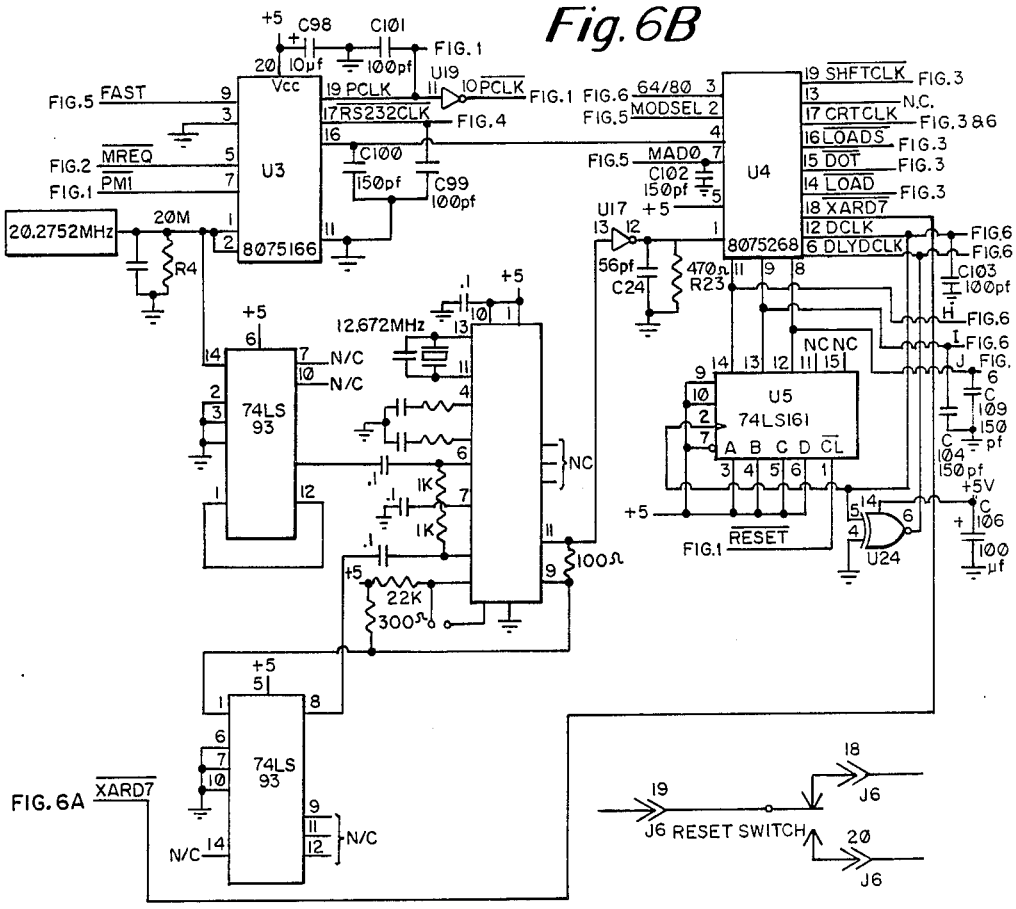
Figure 6B:
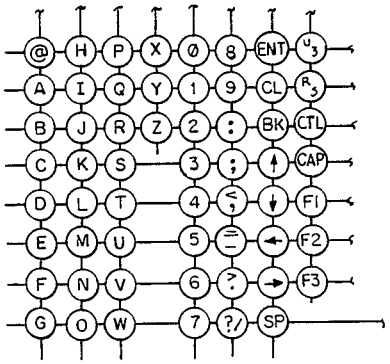
Figure 6B:
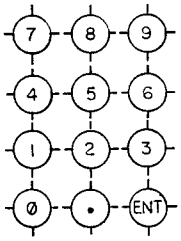
Figure 7:
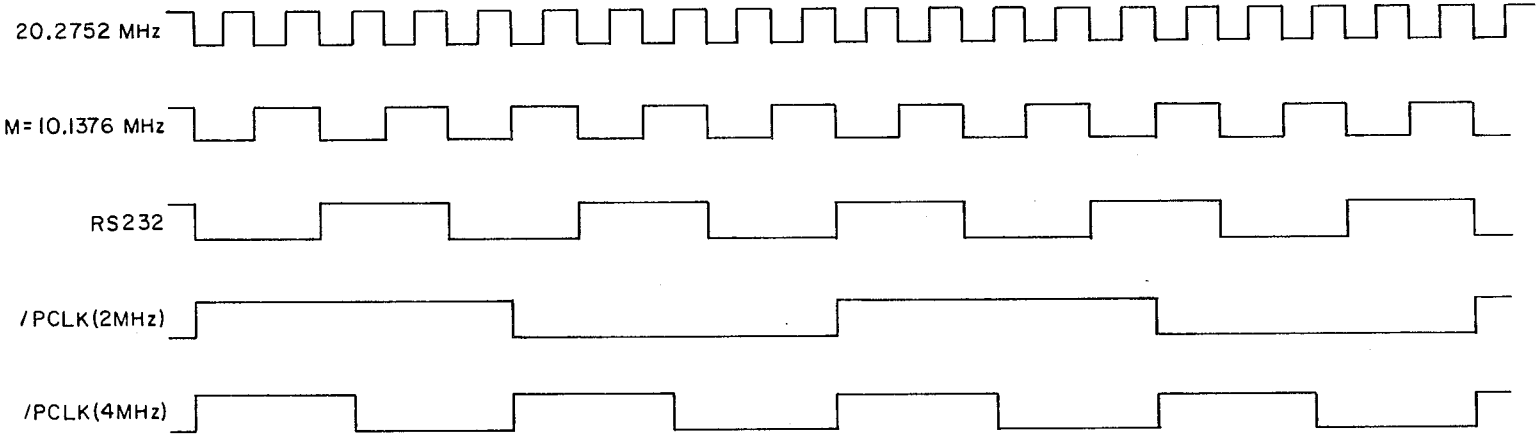
FIGS. 7–9 show timing diagrams associated with the microcomputer system of this invention.
Figure 8:
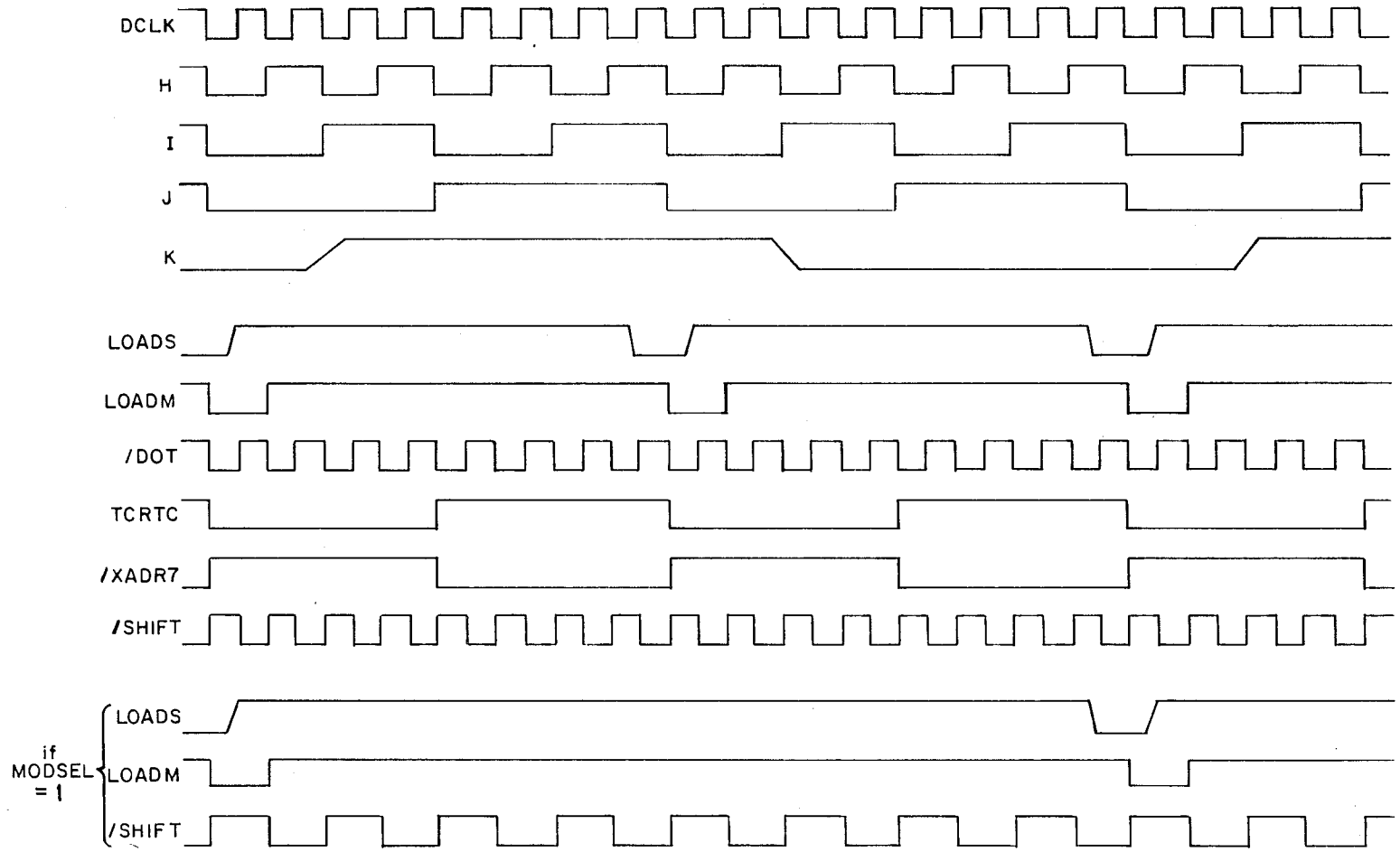
Figure 9:
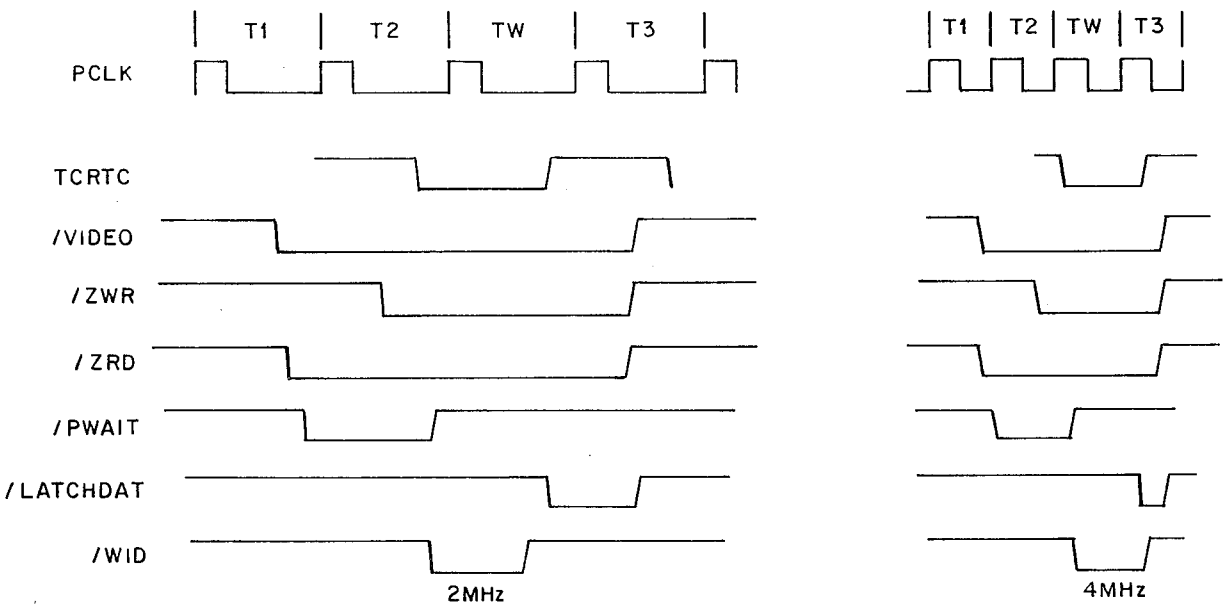

Reference is now made to FIGS. 6A and 6B which show the generation of timing signals in connection with timing for memory access in connection with the microcomputer system. The timing control shown in FIGS. 6A and 6B include the generation of timing signals for the random access memory of FIG. 3A as well as timing signals for the video RAM. In this connection, reference is made to FIG. 3A which shows the main memory 10 and the video ram 34.

In FIGS. 6A and 6B the signals that have to do with the timing for the random access memory include the signals SMUX-, RAS-, and ICAS-. The timing signals that relate to the video RAM include the signals PWAIT-, OE-, WID-, VBON-, and LATCH DAT-.

FIG. 6A also shows a number of input signals, many of which originate from the central processing unit, which in the preferred embodiment, is a type Z80 processor. Also shown in FIGS. 6A and 6B is part of the circuitry of FIG. 3A shown in block form. This part includes the multiplexer 36 and the video RAM 34. It is the signal identified in FIG. 6 as the signal WID- that is coupled to pin 11 of the multiplexer 36. This is a window signal for providing a window for writing to the the video RAM.

Read and write signals are coupled directly from the Z80 processor and are identified in FIG. 6A as signals ZWR- and ZRD-. These two signals couple to the gate 110. The output of the gate 110 couples to the data input of the flip-flop 114. The clocking of the flip-flop 114 is from the signal XADR7-. This signal is basically an inversion of the signal CRT CLK shown and discussed in connection with FIG. 3A. The clearing of flip-flop 114 is from the signal VIDEO- by way of the inverter gate 116. The signal VIDEO- also couples to one input of the gate 118 to assert RWAIT-. The assertion output of the flip-flop 114 couples to the other input of the gate 118. The setting of the flip-flop 114 indicates video access in progress. Since it is known that the video access is now in progress, the signal PWAIT- is released. The output of flip-flop 114 also enables gate 124 and by way of gate 122 starts the timing of the delay line 120. The setting of flip-flop 114 occurs upon either a read or write signal from the central processing unit passing by way of the gate 110 with a high level signal at the output thereof for presentation to the flip-flop 114.

The output signal from gate 118 is the signal PWAIT- which couples back to the central processing unit. This signal functions as a wait line for the Z80 processor. This action is utilized by the Z80 processor to synchronize to asynchronous signals.

FIG. 6A also shows a delay line 120 which has an input from the NOR gate 122. One input to the gate 122 is the output of flip-flop 114 and the others to the gate 122 is the signal MCYCEN which is a memory cycle enable signal. This is generated through logic from the central processing unit and is for enabling the memory cycle. The delay line 120 has a series of taps that provide for different timing functions with different predetermined delays used to carry out controls of the signals particularly for control of the random access memory 10 and the video RAM 34 shown in FIG. 3B.

The gate 118 which generates the signal PWAIT- is connected so that the signal is present when the signal VIDEO- occurs but terminates upon the setting of the flip-flop 114. It is noted that the output of the flip-flop 114 also connects to the gate 124. The gate 124 is instrumental in control of the video window. While the output of gate 124 is high, the output at inverter 126 is low and this provides one input enable to the gate 128. The other input to the gate 128 is the signal MWR-. If the system is in a write cycle, then the gate 128 is enabled and has a low output. This in turn enables gate 130. This is the signal that is coupled to the multiplexer 36.

The access in progress signal on line 115, as mentioned previously, has a line that couples to the NOR gate 122. The output of the NOR gate 122 couples to the delay line 120. This access in progress signal on line 115 essentially starts the delay line 120 and upon receipt of a low going signal at the pin 12 of the delay 120, the gate 130 is enabled. The dispersed output of the delay line 120 is a 30 nanosecond tap. Thus, the first tap of the delay line essentially starts the video window at the gate 130. This signal identified as the signal SMUX- also couples to gate 136 and provides the video buffer on signal identified as signal VBON-. This is for enabling the video buffer 46, as noted in FIG. 3B. This occurs when the signal WE- is low.

The second signal from the delay line at tap 60 is a signal ICAS-. The delayed pulse travels down the delay line to the third tap which is tap 150 which couples to a second input of the AND gate 124. When the signal at pin 10 goes low this essentially ends the video window. This low signal provides a high output to pin 4 of gate 130, thus terminating the window signal with the signal WID- going high. This brings the signal WE- high and concludes the right cycle to the video ram. This also disables the signal VBON- which in turn turns off the video buffer 46.

Figures 1, 3, 4, 5A, 5B, 6:
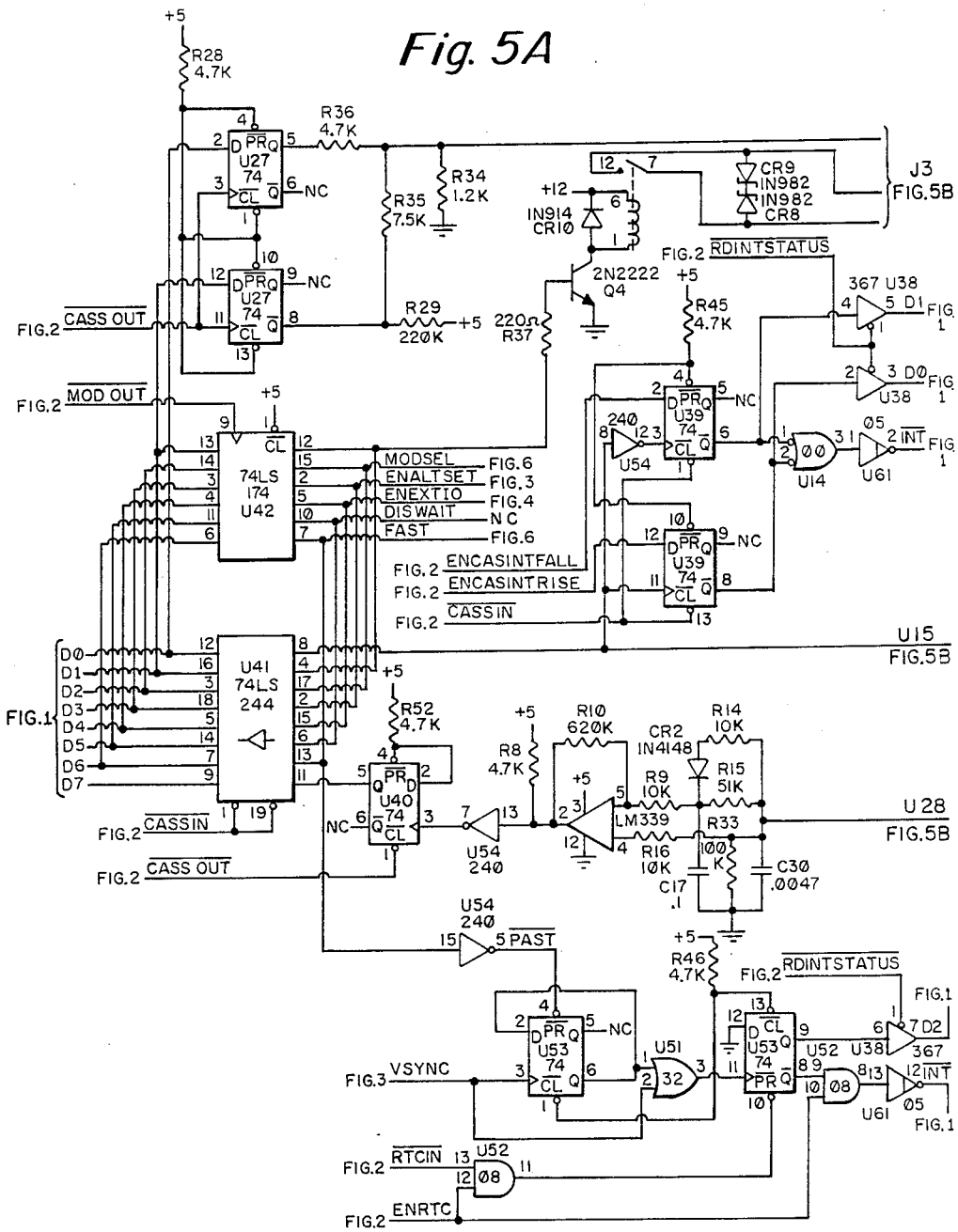
FIGS. 5A and 5B show a portion of the microcomputer system including cassette porting.
Figure 5B:
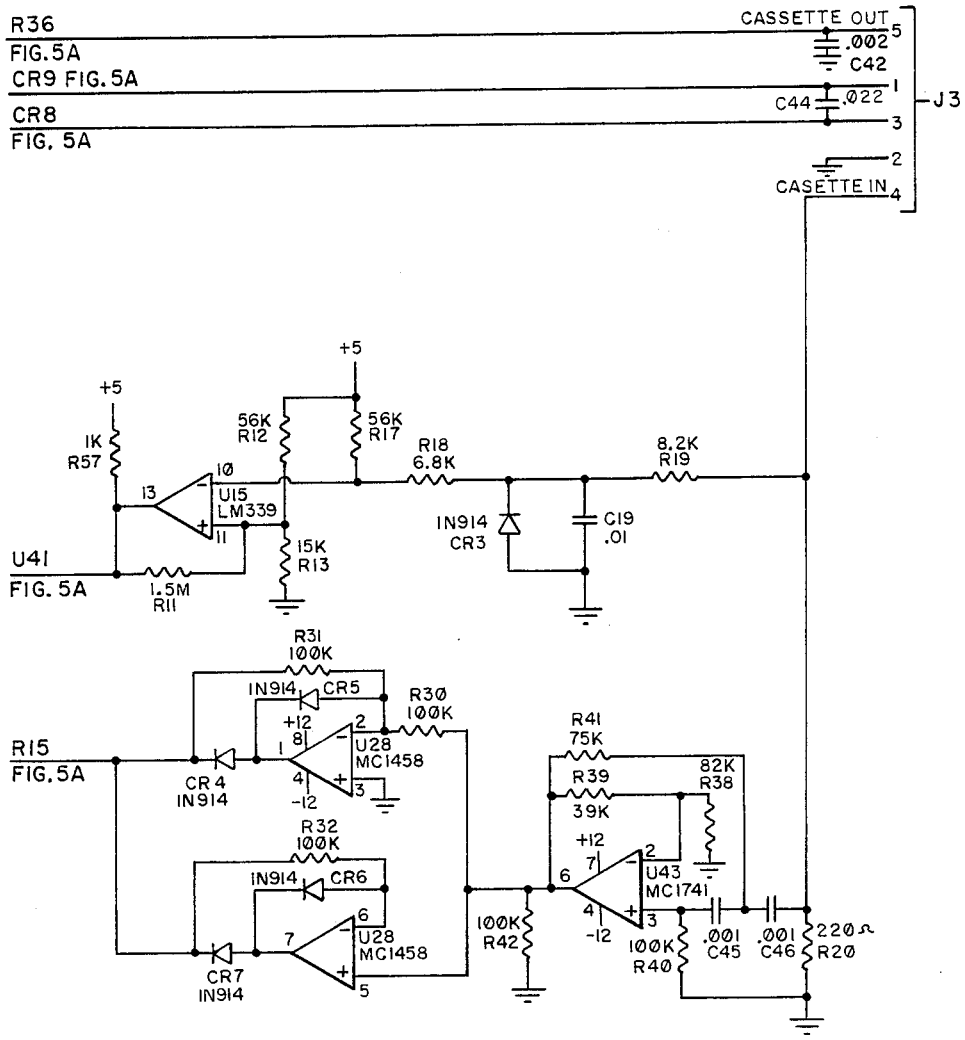

With conclusion of the write cycle there is still a pulse progressing down the delay line 120. One can now assume that there is a read sequence. At the commencement thereof the signal OE- is still low and thus the video RAM 34 is not enabled. At the 240 tap at pin 6 of the delay line there is then provided the signal LATCH DAT-. This low signal as indicated in FIG. 3 couples to the line 45 thereby latching data from the video data bus 42 to the data bus 18. This is for reading data from the video data RAM to the CPU. The data is held in the latch 44 until the signal VIDEO- terminates. It is noted that this action by way of the inverter 116 clears the flip-flop 114 and in turn resets the circuit for further operation.

In FIG. 6A the signal MWR- as mentioned previously is instrumental in not only control of the gate 128 but also in generating of the signal OE- which is the output enable signal for the video RAM 34. In this connection the gate set 134 also receives the signal CRT CLK and the output therefrom is the aforementioned signal OE-. The signal CRT CLK is an alternating signal and depending upon the state thereof, there is essentially an interlacing between control from the cathode ray tube controller (CRTC) 30 or the address lines from the central processing unit (CPU). When the signal CRT CLK is high, then the multiplexers 36, 38, and 40 provide control from the CRTC 30. The address lines are presented from the cathode ray tube controller 30 and the write enable input to the video RAM is held enabled. The signal OE- is also at a state that provides an output enabling of the video RAM. In fact, the output of the gate set 134 has only one condition that brings its output high and that is when the signal CRT CLK is low and during a write cycle as controlled by the signal MWR-. Thus, during a CPU write cycle, a window is established by the signal WID- and data is written by way of the video data write buffer 46 into the video RAM 34.

FIG. 6A also shows additional logic control such as the gate 136 which is used for generating the signal VBON-. As indicated previously, this signal is used in the control of the video data write buffer 46. There is also provided a second gate set 138 that generates at its output the signal RAS-. This signal is used in connection with control of the random access memory shown in FIG. 1. The inputs to the gate set 138 are from the tap 300 delay line 120 and also from the signal PRECHG coupled by way of the inverter 139. The other input signal to this gate set is the Z80 signal for a memory request, namely signal MREQ. It is noted that the delay line 120 also generates on a properly timed basis, the signal ICAS- and the signal SMUX- for the dynamic RAM timing.

FIG. 6A slso shows the generation of the signal WAIT- from the flip-flop 140. This signal is coupled to the central processing unit and is another one of the WAIT functions for the control of the Z80 processor.

With regard to the control in accordance with the present invention, reference is made to FIG. 3B and the video RAM 34 and also to the cathode ray tube controller 30. The central processing unit address lines couple to the three multiplexers 36, 38, and 40. The control input to each of these multiplexers is at the input pin 1. This control is the signal CRT CLK. This is an alternating signal which, it is noted, is also coupled to the cathode ray tube controller 30. This is the basic clock for the controller 30 for screen refresh but also functions to permit reading from and writing into the video RAM under CPU control.

Thus, when the signal CRT CLK is high, this conditions the multiplexers 36, 38, and 40 to bring addresses directly from the cathode ray tube controller 30. These are shown in FIG. 3B as the B1–B4 addresses which couple to the output line Y1–Y4. This control is for refreshing of the display. Thus, during this state of the signal CRT CLK, the video RAM data is read out into the video output latch 48 and to the character generator ROM 50. The latch 48 latches this data on its portion of the CRT CLK signal or in other words when this signal is high. This provides for a refreshing of the screen and yet, as described hereinafter, data transfer is capable of occurring between the CPU and the video RAM in an interlaced manner on the alternate cycle of the CRT CLK signal so as to enable updating.

Now, when the signal CRT CLK goes to its low state, it is during this low condition that data can be read from the video RAM to the CPU and data can also be written into the video RAM from the CPU. In this regard, the video data read latch 44 and the video data write buffer 46 are used in this control. When the signal CRT CLK goes low then the control of the multiplexers 36, 38, and 40 changes so that the addresses A1–A4 couple to the outputs Y1–Y4. These addresses couple directly from the CPU address bus with the exception of one of the inputs which is the signal WID- which connects by way of the multiplexer 36 to the input WE- of the video RAM. During this phase of operation this is where the signals VBON- and LATCH DAT- previously referred to in connection with FIG. 6A are instrumental in providing data transfer either on a READ sequence or a WRITE sequence.

If one first assumes that the control is such that it is a write cycle, then the signal VBON- enables the video data write buffer and data is written into the video RAM. Under this condition, the signal OE- is high and thus the output of the video RAM is disabled because it is being written into. This control is provided by way of the gate set 134 of FIG. 6A.

In the sequence of operation, one can then assume that the signal CRT CLK then reverts to its high level and the addresses to the video RAM then switch again to the cathode ray tube controller 30. There is thus a continuous refreshing of the video RAM data under control of the CRT CLK. When the signal then reverts again to its low state, during a subsequent read cycle, the video data write buffer 46 is disabled and the video data read latch 44 is enabled. Data may then be read from the video data bus 42 by way of the video read latch 44 to the CPU data bus.

Thus, there is provided for a read and write sequence with regard to the video RAM, not during any blanking sequence, but actually interleaved with the video RAM refreshing cycle.

There is also described herein tables showing the design for a number of PAL's used in the micro computer system along with mapping equations.

Parts List, CPU PCB #6700104AA3
Model 4 16K, Cassette Input
Catalog number 26-1067
(2/16/83)

| Item | Qty | Description | Mfgr's Part No. |
|---|---|---|---|
| 1 | 4 | Cap, 100 pfd 50V C. Disk (C1,99,101, 103) | 8301104 |
| 2 | 3 | Cap, 10 ufd 35V Elec. Rad (C2-4) | 8326103 |
| 3 | 74 | Cap, 0.1 ufd 50V Mono Axial (C5,11-18,23,26-29,31,33-37,39-41, 43,47-55,57-97) | 8374104 |
| 4 | 1 | Cap, 56 pfd 50V C. Disk NPO (C6) | 8300563 |
| 5 | 2 | Cap, 47 pfd 50V C. Disk NPO (C7,9) | 8300472 |
| 6 | 2 | Cap, 56 pfd 50V C. Disk (C8,24) | 8300564 |
| 7 | 1 | Cap, 100 pfd 50V C. Disk (C10) | 8301103 |
| 8 | 1 | Cap, .01 ufd 50V C. Disk (C19) | 8303104 |
| 9 | 1 | Cap, 22 ufd 16V Elec. Rad(C20) | 8326221 |
| 10 | 4 | Cap, .022 ufd 50V C. Disk (C21,32, 44,108) | 8303224 |
| 11 | 1 | Cap, 33 pfd 50V C. Disk (C22) | 8300334 |
| 12 | 1 | Cap, .0047 ufd 50V C. Disk (C30) | 8302474 |
| 13 | 1 | Cap, .0022 ufd 50V C. Disk (C42) | 8302224 |
| 14 | 2 | Cap, .001 ufd 50V Mono Axial (C45,46) | 8372104 |
| 15 | 1 | Cap, 200 pfd 50V (C56) | 8301204 |
| 16 | 1 | Cap, 10 ufd 10V Tant. (C98) | 8336101 |
| 17 | 5 | Cap, 150 pfd 50V C. Disk (C100,102 104,107,109) | 8301154 |
| 18 | 1 | Cap, 100 ufd 10V Tant. (C106) | 8337101 |
| 19 | 2 | Connector, 4-Pin Right Angle (J4,J11) | 8519079 |
| 20 | 1 | Connector, 5-Pin Right Angle (J3) | 8519091 |
| 21 | 1 | Connector, 6-Pin Right Angle (J5) | 8519103 |
| 22 | 1 | Connector, Dual 10 Rt. Angle Header (J6) | 8519107 |
| 23 | 2 | Connector, 20-Pin Flat Flex Cable (J7,8) | 8519101 |
| 24 | 1 | Connector, 17-Pin Dual Header (J10) | 8519169 |
| 25 | 8 | Diode, 1N4148 Zener 75V (CR1-7,10) | 8150148 |
| 26 | 1 | Ferrite Bead (FB1) | 8419014 |
| 27 | 1 | Inductor, 47uH (L1) | 8419028 |
| 28 | 1 | Inductor, .68uH (L2) | 8419029 |
| 29 | 1 | IC, 74LS175 Quad Flip-Flop (U2) | 8020175 |

| | | | |
|---|---|---|---|
| 30 | 1 | IC, PAL16R6A (U3) | 8075166 |
| 31 | 1 | IC, PAL16L8 (U4) | 8075268 |
| 32 | 1 | IC, 74LS161 Binary Counter (U5) | 8020161 |
| 33 | 8 | IC, 74LS244 Quad Tranceiver (U6,10, 41,55,56,64,67,74) | 8020244 |
| 34 | 1 | IC, 74LS373 Octal Latch (U7) | 8020373 |
| 35 | 2 | IC, 74LS273 Octal Flip-Flop (U8,37) | 8020273 |
| 36 | 1 | IC, 74LS153 Dual Multiplexer (U9) | 8020153 |
| 37 | 1 | IC, 74LS166 Shift Register (U11) | 8020166 |
| 38 | 2 | IC, 74LS51 AND OR Invert (U12,20) | 8020051 |
| 39 | 2 | IC, 74LS00 Quad 2-IN NAND (U13,14) | 8020000 |
| 40 | 1 | IC, LM339 Comparator (U15) | 8050339 |
| 41 | 3 | IC, 74LS32 Quad 2-IN OR (U16,22,51) | 8020032 |
| 42 | 1 | IC, 74LS14 Hex Inverter (U17) | 8020014 |
| 43 | 3 | IC, 74LS174 Flip-Flop (U18,36,42) | 8020174 |
| 44 | 1 | IC, 74S04 (U19) | 8010004 |
| 45 | 1 | IC, 4016 200NS RAM 2K X 8 Static (U21) | 8040116 |
| 46 | 1 | IC, MCM68A316E Character Generator (U23) | 8044316 |
| 47 | 1 | IC, 74LS86 Quad 2-IN OR (U24) | 8020086 |
| 48 | 1 | IC, 74LS04 Hex Inverter (U25) | 8020004 |
| 49 | 3 | IC, 74LS08 Quad 2-IN AND (U26,46,52) | 8020008 |
| 50 | 5 | IC, 74LS74 Dual Flip-Flop (U27,31,39 40,53) | 8020074 |
| 51 | 1 | IC, MC1458 OP-AMP (U28) | 8050458 |
| 52 | 2 | IC, 7406 Hex Inverter (U29,30) | 8000006 |
| 53 | 1 | IC, 74LS10 Triple 3-IN NAND (U32) | 8020010 |
| 54 | 3 | IC, 74LS157 Quad Multiplexer (U33-35) | 8020157 |
| 55 | 2 | IC, 74LS367 Memory (U38,75) | 8020367 |
| 56 | 1 | IC, MC1741 OP-AMP (U43) | 8050741 |
| 57 | 2 | IC, MC14502 B CMOS Driver (U44,45) | 8030502 |
| 58 | 1 | IC, SY68045 CTC 60HZ (U47) | 8040045 |
| 59 | 3 | IC, 74LS138 Decoder (U48-50) | 8020138 |
| 60 | 2 | IC, 74LS240 Octal Buffer (U54,60) | 8020240 |
| 61 | 1 | IC, Z80A CPU (U57) | 8047880 |
| 62 | 1 | IC, PAL10L8 (U58) | 8075208 |
| 63 | 1 | IC, PAL16L8 (U59) | 8075368 |
| 64 | 1 | IC, 7405 O.C. Buffer (U61) | 8000005 |
| 65 | 1 | IC, 74LS02 Quad 2-IN NOR (U62) | 8020002 |
| 66 | 2 | IC, 74157 Quad Multiplexer (U63,76) | 8000157 |
| 67 | 1 | IC, 74LS123 Dual Multivibrator (U65) | 8020123 |
| 68 | 1 | IC, 74LS374 Octal Flip-Flop (U66) | 8020374 |
| 69 | 1 | IC, MCM68A364 ROM A (U68) | 8041364 |
| 70 | 1 | IC, MCM68A332 ROM B (U69) | 8040332 |
| 71 | 1 | IC, MCM68A316 ROM C (U70) | 8048316 |
| 72 | 2 | IC, 74LS245 Octal Tranceiver (U71,73) | 8020245 |
| 73 | 1 | IC, DIP Shunt 4-POS. (U72) | 8489057 |
| 74 | 8 | IC, MCM4116 16K RAM 200NS (U77-84) | 8042016 |
| 75 | 1 | IC, 74LS30 Positive NAND (U93) | 8020030 |
| 76 | 1 | Relay, 12V 2 AMP (K1) | 8429105 |
| 77 | 2 | Res, 510 ohm, 5% 1/4W (R1,59) | 8207151 |
| 78 | 1 | Res, 12K ohm, 5% 1/4W (R2) | 8207312 |
| 79 | 1 | Res, 6.2K ohm, 1/4W (R3) | 8207262 |
| 80 | 2 | Res, 470 ohm, 5% 1/4W (R4,23) | 8207147 |
| 81 | 4 | Res, 10K ohm, 5% 1/4W (R5,9,14,16) | 8207310 |
| 82 | 1 | Res, 3.6K ohm, 5% 1/4W (R6) | 8207236 |
| 83 | 1 | Res, 91 ohm, 5% (R7) | 8207091 |
| 84 | 13 | Res, 4.7K ohm, 5% 1/4W (R8,28,36, 43-49,52,54,60) | 8207247 |
| 85 | 1 | Res, 620K ohm, 5% 1/4W (R10) | 8207462 |
| 86 | 1 | Res, 1.5M ohm, 5% 1/4W (R11) | 8207515 |

| | | | |
|---|---|---|---|
| 87 | 2 | Res, 56K ohm, 5% 1/4W (R12,17) | 8207356 |
| 88 | 2 | Res, 15K ohm, 5% 1/4W (R13) | 8207315 |
| 89 | 1 | Res, 51K ohm, 5% 1/4W (R15) | 8207351 |
| 90 | 1 | Res, 6.8K ohm, 5% 1/4W (R18) | 8207268 |
| 91 | 1 | Res, 8.2K ohm, 5% 1/4W (R19) | 8207282 |
| 92 | 3 | Res, 220 ohm, 5% 1/4W (R20,27,37) | 8207122 |
| 93 | 1 | Res, 680 ohm, 5% 1/4W (R21) | 8207168 |
| 94 | 7 | Res, 100K ohm, 5% 1/4W (R22,30-33, 40,42) | 8207410 |
| 95 | 1 | Res, 750 ohm, 5% 1/4W (R24) | 8207175 |
| 96 | 2 | Res, 1.2K ohm, 5% 1/4W (R25,34) | 8207212 |
| 97 | 1 | Res, 22 ohm, 5% 1/4W (R26) | 8207022 |
| 98 | 1 | Res, 220K ohm, 5% 1/4W (R29) | 8207422 |
| 99 | 1 | Res, 7.5K ohm, 5% 1/4W (R35) | 8207275 |
| 100 | 1 | Res, 82K ohm, 5% 1/4W (R38) | 8207382 |
| 101 | 1 | Res, 39K ohm, 5% 1/4W (R39) | 8207339 |
| 102 | 1 | Res, 75K ohm, 5% 1/4W (R41) | 8207375 |
| 103 | 1 | Res, 20K ohm, 5% 1/4W (R50) | 8207320 |
| 104 | 4 | Res, 150 ohm, 5% 1/4W (R51,53,55,56) | 8207150 |
| 105 | 1 | Res, 1K ohm, 5% 1/4W (R57) | 8207210 |
| 106 | 1 | Res, 56 ohm, 5% 1/4W (R58) | 8207056 |
| 107 | 1 | Res Pak, 820 ohm, SIP 10-PIN (RP1) | 8290182 |
| 108 | 1 | Res Pak, 4.7K ohm, SIP 8-PIN (RP2) | 8292246 |
| 109 | 1 | Res Pak, 27 ohm, DIP 16-PIN (RP4) | 8290027 |
| 110 | 1 | Transistor, 2N918 (Q1) | 8110918 |
| 111 | 2 | Transistor, 2N3906 PNP (Q2,3) | 8100906 |
| 112 | 1 | Transistor, 2N2222 (Q4) | 8110222 |

MISCELLANEOUS

| | | | |
|---|---|---|---|
| 113 | 1 | Crystal, 20.2752 MHz (Y1) | 8409031 |
| 114 | 1 | Crystal, 12.672 MHz (Y2) | 8409030 |
| 115 | 3 | Jumper Wire 20 Gauge (W1-3) | *NOTE |
| 116 | 1 | PCB Logic Board, Rev. PP3 | 8709296 |
| 117 | 1 | Regulator, 79L05, -5V (Q5) | 8051905 |
| 118 | 7 | Socket, 20-Pin DIP (U3,4,58,59,71-73) | 8509009 |
| 119 | 5 | Socket, 24-Pin DIP (U21,23,68-70) | 8509001 |
| 120 | 2 | Socket, 40-Pin DIP (U47,57) | 8509002 |
| 121 | 16 | Socket, 16-Pin DIP (U77-84,85-92) | 8509003 |
| 122 | 13 | Staking Pin (E1-8,11-15) | 8529014 |

Note: W1,W3 are 4-1/2" long, W2 is 6" long

| | | | |
|---|---|---|---|
| 1 | 4 | Cap, 100 PFD 50V C. Disk (C1,99,101, 103) | 8301104 |
| 2 | 3 | Cap, 10 MFD 35V ELEC. RAD (C2-4) | 8326103 |
| 3 | 58 | Cap, 0.1MFD 50V MONO AXIAL (C5,11-18,23,26-29,31,33-37,39-41, 43,47-55,57-65,67,69,71,73,75,77,79 81,83,85,87,89,91,93,95,97) | 8374104 |
| 4 | 1 | Cap, 56 PFD 50V C. DISK NPO (C6) | 8300563 |
| 5 | 2 | Cap, 47 PFD 50V C. DISK NPO (C7,9) | 8300472 |
| 6 | 2 | Cap, 56 PFD 50V C. DISK (C8,24) | 8300564 |
| 7 | 1 | Cap, 100 PFD 50V C. DISK (C10) | 8301103 |
| 8 | 1 | Cap, .01 MFD 50V C. DISK (C19) | 8303104 |
| 9 | 1 | Cap, 22 MFD 16V ELEC. RAD(C20) | 8326221 |
| 10 | 4 | Cap, .022 MFD 50V C. DISK (C21,32, 44,108) | 8303224 |
| 11 | 1 | Cap, 33 PFD 50V C. DISK (C22) | 8300334 |
| 12 | 1 | Cap, .0047 MFD 50V C. DISK (C30) | 8302474 |
| 13 | 1 | Cap, .0022 MFD 50V C. DISK (C42) | 8302224 |
| 14 | 2 | Cap, .001 MFD 50V MONO AXIAL (C45,46) | 8372104 |

| | | | |
|---|---|---|---|
| 15 | 1 | Cap, 200 PFD 50V (C56) | 8301204 |
| 16 | 1 | Cap, 10 MFD 10V TANT. (C98) | 8336101 |
| 17 | 5 | Cap, 150 PFD 50V C. DISK (C100,102 104,107,109) | 8301154 |
| 18 | 1 | Cap, 100 MFD 10V TANT. (C106) | 8337101 |
| 19 | 2 | Connector, 4-Pin Right Angle (J4,J11) | 8519079 |
| 20 | 1 | Connector, 5-Pin Right Angle (J3) | 8519091 |
| 21 | 1 | Connector, 6-Pin Right Angle (J5) | 8519103 |
| 22 | 1 | Connector, Dual 10 Rt. Angl. Header (J6) | 8519107 |
| 23 | 2 | Connector, 20-Pin Flat Flex Cable (J7,8) | 8519101 |
| 24 | 1 | Connector, 17-Pin Dual Header (J10) | 8519169 |
| 25 | 8 | Diode, 1N4148 Zener 75V (CR1-7,10) | 8150148 |
| 26 | 1 | Ferrite Bead (FB1) | 8419014 |
| 27 | 1 | Inductor, 47uH (L1) | 8419028 |
| 28 | 1 | Inductor, .68uH (L2) | 8419029 |
| 29 | 1 | IC, 74LS175 Quad Flip-Flop (U2) | 8020175 |
| 30 | 1 | IC, PAL16R6A (U3) | 8075166 |
| 31 | 1 | IC, PAL16L8 (U4) | 8075268 |
| 32 | 1 | IC, 74LS161 Binary Counter (U5) | 8020161 |
| 33 | 8 | IC, 74LS244 Quad Tranceiver (U6,10, 41,55,56,64,67,74) | 8020244 |
| 34 | 1 | IC, 74LS373 Octal Latch (U7) | 8020373 |
| 35 | 2 | IC, 74LS273 Octal Flip-Flop (U8,37) | 8020273 |
| 36 | 1 | IC, 74LS153 Dual Multiplexer (U9) | 8020153 |
| 37 | 1 | IC, 74LS166 Shift Register (U11) | 8020166 |
| 38 | 2 | IC, 74LS51 AND OR Invert (U12,20) | 8020051 |
| 39 | 2 | IC, 74LS00 Quad 2-In NAND (U13,14) | 8020000 |
| 40 | 1 | IC, LM339 Comparator (U15) | 8050339 |
| 41 | 3 | IC, 74LS32 Quad 2-In OR (U16,22,51) | 8020032 |
| 42 | 1 | IC, 74LS14 Hex Inverter (U17) | 8020014 |
| 43 | 3 | IC, 74LS174 Flip-Flop (U18,36,42) | 8020174 |
| 44 | 1 | IC, 74S04 (U19) | 8010004 |
| 45 | 1 | IC, 4016 200NS RAM 2K X 8 Static (U21) | 8040116 |
| 46 | 1 | IC, MCM68A316E Character Generator (U23) | 8044316 |
| 47 | 1 | IC, 74LS86 Quad 2-In OR (U24) | 8020086 |
| 48 | 1 | IC, 74LS Hex Inverter (U25) | 8020004 |
| 49 | 3 | IC, 74LS08 Quad 2-In AND (U26,46,52) | 8020008 |
| 50 | 5 | IC, 74LS74 Dual Flip-Flop (U27,31,39 40,53) | 8020074 |
| 51 | 1 | IC, MC1458 OP-AMP (U28) | 8050458 |
| 52 | 2 | IC, 7406 Hex Inverter (U29,30) | 8000006 |
| 53 | 1 | IC, 74LS10 Triple 3-In NAND (U32) | 8020010 |
| 54 | 3 | IC, 74LS157 Quad Multiplexer (U33-35) | 8020157 |
| 55 | 2 | IC, 74LS367 Memory (U38,75) | 8020367 |
| 56 | 1 | IC, MC1741 OP-AMP (U43) | 8050741 |
| 57 | 2 | IC, MC14502 B CMOS Driver (U44,45) | 8030502 |
| 58 | 1 | IC, SY68045 CTC 50Hz Version (U47) | 8041045 |
| 59 | 3 | IC, 74LS138 Decoder (U48-50) | 8020138 |
| 60 | 2 | IC, 74LS240 Octal Buffer (U54,60) | 8020240 |
| 61 | 1 | IC, Z80A CPU (U57) | 8047880 |
| 62 | 1 | IC, PAL10L8 (U58) | 8075208 |
| 63 | 1 | IC, PAL16L8 (U59) | 8075368 |
| 64 | 1 | IC, 7405 O.C. Buffer (U61) | 8000005 |
| 65 | 1 | IC, 74LS02 Quad 2-In NOR (U62) | 8020002 |
| 66 | 2 | IC, 74157 Quad Multiplexer (U63,76) | 8000157 |
| 67 | 1 | IC, 74LS123 Dual Multivibrator (U65) | 8020123 |
| 68 | 1 | IC, 74LS374 Octal Flip-Flop (U66) | 8020374 |

| | | | |
|---|---|---|---|
| 69 | 1 | IC, MCM68A364 ROM A (U68) | 8048364 |
| 70 | 1 | IC, MCM68A332 ROM B (U69) | 8040332 |
| 71 | 1 | IC, MCM68A316 ROM C (U70) | 8042316 |
| 72 | 2 | IC, 74LS245 Octal Tranceiver (U71,73) | 8020245 |
| 73 | 1 | IC, DIP Shunt 4-Pos. (U72) | 8489057 |
| 74 | 8 | IC, MCM6665 64K RAM 200NS (U85-92) | 8040665 |
| 75 | 1 | IC, 74LS30 Positive NAND (U93) | 8020030 |
| 76 | 1 | Relay, 12V 2 Amp (K1) | 8429105 |
| 77 | 2 | Res, 510 ohm, 5% 1/4W (R1,59) | 8207151 |
| 78 | 1 | Res, 12K ohm, 5% 1/4W (R2) | 8207312 |
| 79 | 1 | Res, 6.2K ohm, 1/4W (R3) | 8207262 |
| 80 | 2 | Res, 470 ohm, 5% 1/4W (R4,23) | 8207147 |
| 81 | 4 | Res, 10K ohm, 5% 1/4W (R5,9,14,16) | 8207310 |
| 82 | 1 | Res, 3.6K ohm, 5% 1/4W (R6) | 8207236 |
| 83 | 1 | Res, 91 ohm, 5% (R7) | 8207091 |
| 84 | 13 | Res, 4.7K ohm, 5% 1/4W (R8,28,36, 43-49,52,54,60) | 8207247 |
| 85 | 1 | Res, 620K ohm, 5% 1/4W (R10) | 8207462 |
| 86 | 1 | Res, 1.5Meg ohm, 5% 1/4W (R11) | 8207515 |
| 87 | 2 | Res, 56K ohm, 5% 1/4W (R12,17) | 8207356 |
| 88 | 2 | Res, 15K ohm, 5% 1/4W (R13) | 8207315 |
| 89 | 1 | Res, 51K ohm, 5% 1/4W (R15) | 8207351 |
| 90 | 1 | Res, 6.8K ohm, 5% 1/4W (R18) | 8207268 |
| 91 | 1 | Res, 8.2K ohm, 5% 1/4W (R19) | 8207282 |
| 92 | 3 | Res, 220 ohm, 5% 1/4W (R20,27,37) | 8207122 |
| 93 | 1 | Res, 680 ohm, 5% 1/4W (R21) | 8207168 |
| 94 | 7 | Res, 100K ohm, 5% 1/4W (R22,30-33, 40,42) | 8207410 |
| 95 | 1 | Res, 750 ohm, 5% 1/4W (R24) | 8207175 |
| 96 | 2 | Res, 1.2K ohm, 5% 1/4W (R25,34) | 8207212 |
| 97 | 1 | Res, 22 ohm, 5% 1/4W (R26) | 8207022 |
| 98 | 1 | Res, 220K ohm, 5% 1/4W (R29) | 8207422 |
| 99 | 1 | Res, 7.5K ohm, 5% 1/4W (R35) | 8207275 |
| 100 | 1 | Res, 82K ohm, 5% 1/4W (R38) | 8207382 |
| 101 | 1 | Res, 39K ohm, 5% 1/4W (R39) | 8207339 |
| 102 | 1 | Res, 75K ohm, 5% 1/4W (R41) | 8207375 |
| 103 | 1 | Res, 20K ohm, 5% 1/4W (R50) | 8207320 |
| 104 | 4 | Res, 150 ohm, 5% 1/4W (R51,53,55,56) | 8207150 |
| 105 | 1 | Res, 1K ohm, 5% 1/4W (R57) | 8207210 |
| 106 | 1 | Res, 56 ohm, 5% 1/4W (R58) | 8207056 |
| 107 | 1 | Res Pak, 820 ohm, SIP 10-Pin (RP1) | 8290182 |
| 108 | 1 | Res Pak, 4.7K ohm, SIP 8-Pin (RP2) | 8292246 |
| 109 | 1 | Res Pak, 27 ohm, DIP 16-Pin (RP4) | 8290027 |
| 110 | 1 | Transistor, 2N918 (Q1) | 8110918 |
| 111 | 2 | Transistor, 2N3906 PNP (Q2,3) | 8100906 |
| 112 | 1 | Transistor, 2N2222 (Q4) | 8110222 |

MISCELLANEOUS

| | | | |
|---|---|---|---|
| 113 | 1 | Crystal, 20.2752 MHz (Y1) | 8409031 |
| 114 | 1 | Crystal, 12.672 MHz (Y2) | 8409030 |
| 115 | 3 | Jumper Wire, 20 Gauge (W1-3) | *NOTE |
| 116 | 1 | PCB, Logic Board Rev. PP3 | 8709296 |
| 117 | 7 | Socket, 20-Pin DIP (U3,4,58,59,71-73) | 8509009 |
| 118 | 5 | Socket, 24-Pin DIP (U21,23,68-70) | 8509001 |
| 119 | 2 | Socket, 40-Pin DIP (U47,57) | 8509002 |
| 120 | 16 | Socket, 16-Pin DIP (U77-84,85,-92) | 8509003 |
| 121 | 10 | Staking Pin (E1-8,11-15) | 8529014 |

PAL NAME MEMORY Ma-p 64K Page 1 of 2
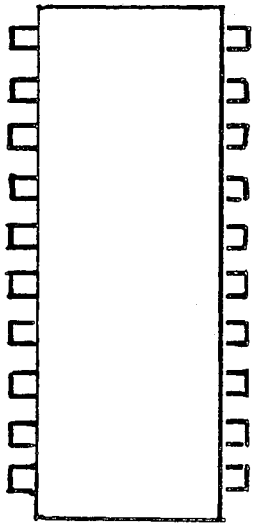
| | | | |
|---|---|---|---|
| SEL2 | 1 | 20 | Vcc |
| SEL1 | 2 | 19 | /DATACNT |
| A15 | 3 | 18 | /VIDEO |
| A14 | 4 | 17 | /KEYB |
| A13 | 5 | 16 | /ROMC |
| A12 | 6 | 15 | /ROMB |
| A11 | 7 | 14 | /ROMA |
| A10 | 8 | 13 | /EXTMEM |
| /MEREQ | 9 | 12 | MCYEN |
| GND | 10 | 11 | SIXTN |
PAL TYPE PAL12L8
INPUTS:
SEL2
SEL1
A15
A14
A13
A12
A11
A10
/MEREQ
SIXTN
/EXTMEM
U59
Tandy #8075368

PAL NAME MEMORY M-p 64K page 2 of 2

OUTPUT & EQUATIONS:

```
If (VCC)DATACNT=A15*MEREQ*/EXTMEM*/S1xTN
               +/A15*/A14*A13*A12*A11*MEREQ/EXTMEM
               +SEL2*MEREQ*/EXTMEM/SIXTN
               +/A15*A14*MEREQ*/EXTMEM
               +SEL1*MEREQ*/EXTMEM*/SIXTN

IF (VCC)VIDEO=/SEL2*/A15*/A14*A13*A12*A11*A10*MEREQ*/EXTMEM
             +SEL2*SEL1*A15*/A14*A13*A12*A11*MEREQ*/EXTMEM*/SIXTN
             +/A15*/A14*A13*A12*A11*A10*MEREQ*/EXTMEM*/SIXTN

IF(VCC)KEYB=SEL2*/SEL1*/A15*/A14*A13*A12*A11*A10*MEREQ*/EXTMEM*/SIXTN
           +/SEL2*/A15*/A14*A13*A12*A11*A10*MEREQ*/EXTMEM
           +/A15*/A14*A13*A12*A11*A10*MEREQ*/EXTMEM*/SIXTN

IF(VCC)ROMB=SEL2*/SEL1*/A15*/A14*A13*A12*MEREQ*/EXTMEM
           +/A15*/A14*A13*A12*MEREQ*/EXTMEM*/SIXTN

IF(VCC)ROMA=SEL2*/SEL1*/A15*/A14*A13*MEREQ*/EXTMEM
           +/A15*/A14*A13*MEREQ*/EXTMEM*/SIXTN

IF(VCC)ROMC=SEL2*/SEL1*/A15*/A14*A13*A12*A11*MEREQ*/EXTMEM
           +/A15*/A14*A13*A12*A11*MEREQ*/EXTMEM*/SIXTN

IF(VCC)/MCYCEN=SEL2*/SEL1*/A15*/A14*A13*A12*A11*MEREQ
              +SEL2*/SEL1*/A15*/A14*A13*A12*A11*MEREQ
              +SEL2*/A15*/A14*MEREQ*/SEL1     O
              +*MEREQ
              +       /A15*MEREQ*      SIXTN
              +       /A14*MEREQ*      SIXTN
              +/SEL2*/SEL1*/A15*/A14*A13*A12*A11*MEREQ
```

TIMING CLK-B

PAL NAME MEMORY M-p 64K Page 1 of 2

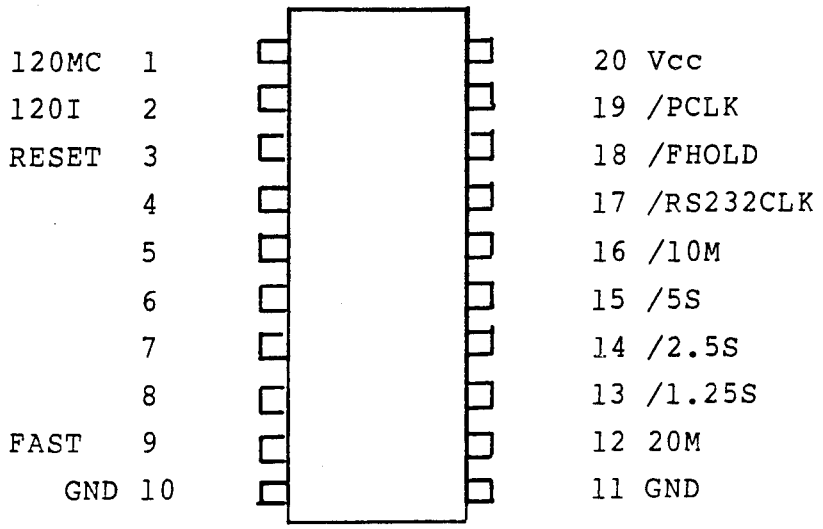

PAL TYPE PAL16R6A

```
INPUTS:
        120MC
        120I
        RESET


        FAST

                                U3
                                Tandy #
                                MMI#
PAL NAME TIMING CLK-B

OUTPUT & EQUATIONS:


                                        2.5S
IF(VCC) PCLK = 20M          */10S*5S*/25S*PSET
              +        10M*/10S*/5S*/2.5S*PSET
              +                            PSET*PCLK

RS232CLK       :=        10M*/RS232CLK
              +        /10M* RS232CLK

        10M    :=       /10M

        10S    :=       /10S*/2.5S

        5S     :=       /10S*/5S
              +         /10S*/5S

        2.5S   :=       10S*5S

        PSET   :=       10S*/5S*/2.5S                    *FAST
              +      /10M        */2.5S                    *FAST
              +                   /2.5S* PSET

If(VCC)20M = 20T
```

PAL NAME TAM3-3 (pp3)
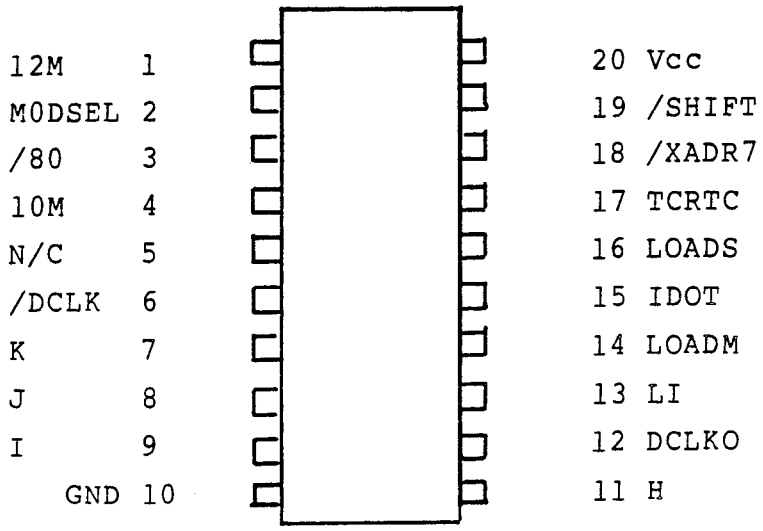
PAL TYPE PAL16L8
INPUTS:
12M
MODSEL
/80
10M
N/C
/DCLK
K
J
I
H
U4
Tandy #8075268
MMI#05403

PAL NAME TAM 3-3
OUTPUT & EQUATIONS:
```
IF(VCC) xADR7     =            J
IF(VCC) /TCRTC    =           /J
IF(VCC) SHIFT     =              DCLK*/MODSEL
                  +  H               * MODSEL
IF(VCC) /LOADM    =  H
                  +   I
                  +    J
                  +                    MODSEL* K

IF(VCC)/DCLKO     =  10M*/80
                  +  12M* 80

IF(VCC)   /L1     =  H* I* J*/K
                  +  H* I* J*/K/MODSEL

IF(VCC) /LOADs    =  /L1
IF(VCC) DOT       =  /10M*/80
                  +  /12* 80
```
CONTROL DECODE (pp3)
PAL NAME MEMORY M-p 64K Page 1 of 2
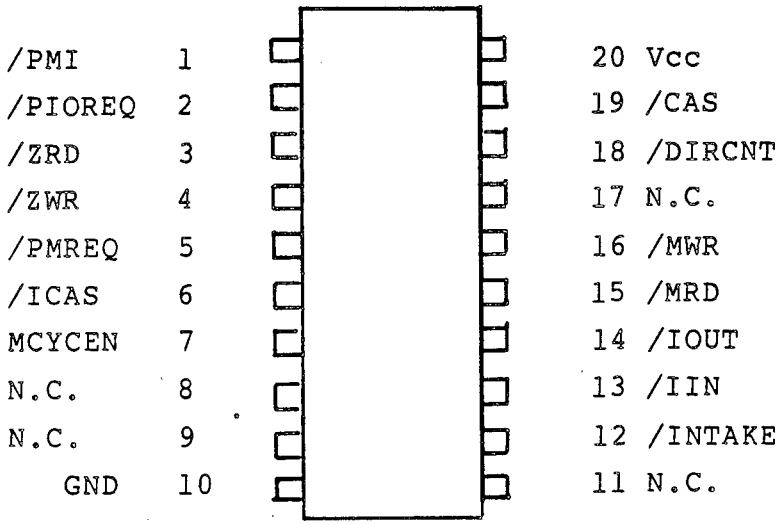
PAL TYPE PAL10L8
INPUTS:
/PMI
/PIOREQ
/ZRD /PMREQ
/ICAS
MCYCEN
U58
Tandy #8075208
MMI#H05373
PAL NAME DECODE CONTROL MODE (pp3)
OUTPUT & EQUATIONS:
```
INTAKE   = PMI * PIOREQ
IIN      = ZRD * PIOREQ
IOUT     = ZWR * PIOREQ
MRD      = ZRD * PMREQ
MWR      = ZWR * PMREQ
         + ZRD
CAS      = ICAS * MCYCEN * SRD
         + ICAS * MCYCEN * ZWR
```
PAL NAME MEM128K MAP
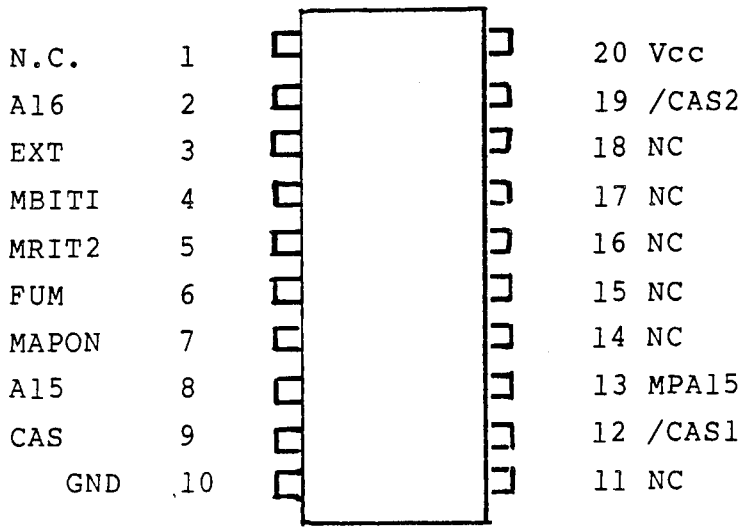
PAL TYPE PAL16L8A
INPUTS:
A16

```
/EXT
MBITI
MBIT2
FUM
MAPON
A15
CAS
```

```
U72
Tandy #8075468
MMI#H05372
6-16-82

PAL NAME MEM128K MAP

OUTPUT & EQUATIONS:


IF(VCC)  CAS1  = CAS*/EXT*/MAPON*/A16
               + CAS*/EXT*/MAPON*     A15* FUM
               + CAS*/EXT*/MAPON*    /A15* FUM*/MBIT2
               + CAS*/EXT*/MAPON*    /A15* FUM
               + CAS*/EXT*/MAPON*     A15* FUM*/MBIT2

IF(VCC)  CAS2  = CAS*/EXT*/MAPON* A16
               + CAS*/EXT*/MAPON*    /A15* FUM*/MBIT2
               + CAS*/EXT*/MAPON*     A15* FUM*/MBIT2

If (VCC) /MPA15=      EXT
               +     /EXT*/MAPON*    /A15
               +     /EXT*/MAPON*    /A15* FUM*/MBIT2
               +     /EXT*/MAPON*    /A15* FUM*       /MBIT1
               +     /EXT*/MAPON*    /A15*/FUM*
               +     /EXT*/MAPON*     A15* FUM* MBIT2*/MBIT1

DESCRIPTION: THIS DOES THE MAPPING OF 128K WITH 32K BLOCKS
```

What is claimed is:

1. In a microcomputer system, a video controller comprising:

a video memory means for storing video data including video character codes and video cell codes, character generator means responsive to said video character codes for providing dot data signals, cell generator means responsive to said video cell codes for providing cell data signals, means coupling the output of the video memory means to the character generator means and to the cell generator means, control means responsive to said video data for selectively enabling one of said character generator means and said cell generator means, a shift register means, means for loading the dot data signals and cell data signals into the shift register means and for shifting the signals therefrom, output gating means, means coupling the output of the shift register means to the output gating means, signal control means having video inverting and video non-inverting states, and means coupling an output control signal from the signal control means to the output gating means to selectively perform inversion of the signal to the output gating means from the shift register means, said signal control means including circuit means having one state indicating inversion and one non-inversion of the character selectively on at least a character-by-character basis, said output gating means including a logic gate means having a signal input for receiving the serial shift register means signal, and a control input for receiving the control signal from the signal control means said logic gate means including an exclusive OR gate that enables the character inversion, said means coupling the output of the video memory means to the character generator means comprising data latch means, alternate set logic means for controlling data flow content from said data latch means to the character generator means so that an alternate character set can be selectively enabled, said alternate set logic means including gate means responsive to an alternate set enabling signal and at least one data bit from said data latch means.

2. A video controller as set forth in claim 1 wherein said means coupling the output of the shift register means to the output gating means comprises an AND gate means having one input for receiving the shift register means serial signal and means establishing a blanking signal and means coupling the blanking signal to the other input of the AND gate means.

3. A video controller as set forth in claim 1 wherein said alternate set logic gate means includes an OR gate means responsive to said alternate set enabling signal or a first data bit.

4. A video controller as set forth in claim 3 wherein said alternate set logic gate means also includes an AND gate means having one input connected from the OR gate means, and a second input from a second data bit and an output coupling to the character generator means at a position corresponding to the second data bit.

5. A video controller as defined in claim 1 wherein said character generator means and said cell generator means have outputs coupled in parallel to data inputs of said shift register means.

6. A video controller as defined in claim 5 wherein said cell generator means includes multiplexer means responsive to row select signals for transferring selected bits of said video cell codes to said shift register.

7. A video controller as defined in claim 6 wherein said control means comprises flip-flop means responsive to said video data for enabling one of said character generator means and said cell generator means.

8. A video controller as defined in claim 7 wherein said character generator means comprises a read only memory which stores dot pattern data for line-by-line scanning of characters.

* * * * *